US010897081B2

(12) United States Patent
Ashida

(10) Patent No.: US 10,897,081 B2
(45) Date of Patent: Jan. 19, 2021

(54) RADIO COMMUNICATION APPARATUS AND PHASE ADJUSTMENT METHOD

(71) Applicant: FUJITSU LIMITED, Kawasaki (JP)

(72) Inventor: Hiroshi Ashida, Fujisawa (JP)

(73) Assignee: FUJITSU LIMITED, Kawasaki (JP)

( * ) Notice: Subject to any disclaimer, the term of this patent is extended or adjusted under 35 U.S.C. 154(b) by 491 days.

(21) Appl. No.: 15/660,066

(22) Filed: Jul. 26, 2017

(65) Prior Publication Data

US 2018/0053998 A1 Feb. 22, 2018

(30) Foreign Application Priority Data

Aug. 22, 2016 (JP) ..... 2016-161638

(51) Int. Cl.
*H01Q 3/26* (2006.01)
*H01Q 3/34* (2006.01)

(52) U.S. Cl.
CPC ..... *H01Q 3/267* (2013.01); *H01Q 3/2605* (2013.01); *H01Q 3/34* (2013.01)

(58) Field of Classification Search
CPC ..... H01Q 3/267; H01Q 3/34; H01Q 3/2605; H04B 17/12; H04B 17/30
See application file for complete search history.

(56) References Cited

U.S. PATENT DOCUMENTS 7,362,266 B2 * 4/2008 Collinson ..... H01Q 3/267 242/174
8,049,662 B2 * 11/2011 Stayton ..... G01S 7/4026 342/165
8,957,808 B2 * 2/2015 Ookawa ..... G01S 7/4004 342/165
9,866,336 B2 * 1/2018 Geis ..... H01Q 3/267
2006/0273959 A1 12/2006 Kawasaki
2012/0146840 A1 6/2012 Ookawa
2015/0139352 A1 5/2015 Matsuo et al.
2017/0234971 A1 * 8/2017 Arai ..... H04B 17/12 342/174

FOREIGN PATENT DOCUMENTS

| | | |
|---|---|---|
| JP | 2004-343468 | 12/2004 |
| JP | 2006-325033 | 11/2006 |
| JP | 2012-122874 | 6/2012 |
| JP | 2014-179785 | 9/2014 |
| JP | 2016-152508 | 8/2016 |
| WO | 2014/141705 A1 | 9/2014 |

OTHER PUBLICATIONS

JPOA—Office Action dated Aug. 4, 2020 for corresponding Japanese Patent Application No. 2016-161638 Full Machine Translation. ** JP2012-122874 cited in the JPOA was previously submitted in the IDS filed on Jul. 26, 2017.

* cited by examiner

*Primary Examiner* — Cassi J Galt
(74) *Attorney, Agent, or Firm* — Fujitsu Patent Cetner

(57) ABSTRACT

A radio communication apparatus includes a first antenna, a second antenna, a third antenna, and a processor that varies a phase difference between a first signal transmitted from the first antenna and a second signal transmitted from the second antenna, measures a received power pattern of a synthesized signal of the first signal and the second signal that is received by the third antenna, and adjusts a phase shift of a signal that is transmitted from the first antenna or the second antenna, based on a difference between the measured received power pattern and a received power pattern obtained by calculation.

5 Claims, 21 Drawing Sheets

$D_{ab} = D_{bc} = D$
$k = 2\pi / \lambda$
$A_a = R[2D] \cdot A = 0.5$
$A_b = R[D] \cdot A = 1.0$
$d\phi = \phi_b - \phi_a$ (PHASE ADJUSTMENT OF ANTENNA 103c)

$A_a = R[D_{ab}] \cdot A$, $A_c = R[D_{bc}] \cdot A$

PHASE INFORMATION (105b)

| PS | ADJUSTMENT VALUE |
|---|---|
| 122 | $d\phi_b$ |
| 123 | $d\phi_c$ |

FIG. 10

$D_{ab} = D_{bc} = D = 2.0$ mm
$k = 2\pi/\lambda$
$d\phi = \phi_b - \phi_a$ $D_{ab} = D_{bc} = D = 2.7$ mm
$k = 2\pi/\lambda$
$d\phi = \phi_b - \phi_a$ $D_{ab} = D_{bc} = D = 2.0$ mm
$k = 2\pi / \lambda$
$d\phi = \phi_c - \phi_a$

MODIFICATION

MODIFICATION

MODIFICATION

RADIO COMMUNICATION APPARATUS AND PHASE ADJUSTMENT METHOD

CROSS-REFERENCE TO RELATED APPLICATION

This application is based upon and claims the benefit of priority of the prior Japanese Patent Application No. 2016-161638, filed on Aug. 22, 2016, the entire contents of which are incorporated herein by reference.

FIELD

The embodiments discussed herein are related to a radio communication apparatus and a phase adjustment method.

BACKGROUND

In recent years, radio communication technologies using electromagnetic waves at high frequency (from a few GHz to several hundreds of GHz) such as millimeter waves and the like have been attracting attention. High-frequency electromagnetic waves are used for vehicle-mounted radar apparatuses that detect an obstacle, an approaching vehicle, and the like, in a certain direction. In particular, millimeter waves are being studied for application to radio communication systems in which a base station covering a small area communicates wirelessly with each user terminal by directing a beam. In such apparatuses and systems, the detection accuracy and communication quality are improved by accurately controlling the directivity of the beam.

A radar apparatus and a radio communication apparatus that transmits and receives beams at a base station include an antenna unit that outputs an electromagnetic wave, and a control circuit that controls output from the antenna unit. Further, in order to enable switching of the directivity of the beam, an antenna array having a plurality of antennas is used as the antenna unit. The directivity of the beam may be switched by controlling the amplitude and the phase of the signal supplied to each antenna.

Each antenna of the antenna array and the control circuit are connected with a feed line (for example, an interconnect such as metal wire and the like). The length of the feed line affects the phase of the signal that is transmitted from the antenna connected to the feed line. The control circuit adjusts the phase of the signal such that the beam is directed in a specific direction, in consideration of the length of the feed line connected to the antenna.

The adjustment amount of the phase may be calculated from the power distribution and the like of signals that are transmitted from the antenna array and received by using an external antenna, for example. In the case where the feed lines have the same length, if signals that have opposite phases at the position of the external antenna are transmitted from two antennas, the signals received by the external antenna are expected to cancel each other out. However, if there is a difference in length between the feed lines, a phase shift is generated between the signals, so that the power of the signals received by the external antenna is greater than the expected value.

As described above, by using an external antenna, it is possible to detect the phase shift caused by the difference in length between the feed lines, and adjust the phase shift using the control circuit. However, adjustment of a phase shift using an external antenna may be performed only on limited occasions such as a communication test before shipment of the radio communication apparatus. Therefore, if a further phase shift is caused by secular changes in the feed lines, an error occurs in the directivity control, which may result in a reduction in detection accuracy and communication quality.

As for adjustment of a phase shift, there has been proposed a method that detects a phase difference and the like between signals flowing through two different feed lines, using an inter-branch error detector disposed between the feed lines, and adjusts the phase shift based on the detected phase difference and the like. There has been also proposed a method that receives a synthesized signal of signals transmitted from two antennas, using a synthesized signal detection line disposed between the antennas, and adjusts a phase shift based on the power of the received synthesized signal.

See, for example, Japanese Laid-open Patent Publications No. 2004-343468 and No. 2014-179785.

However, according to the above method using an inter-branch error detector, the phase shift on a line extending ahead of the inter-branch error detector and including an antenna unit is not adjusted. Further, according to the above method using a synthesized signal detection line, conductors are disposed in the vicinity of the respective antennas, so that the antenna characteristics are changed by the conductors. Therefore, there is a risk that a phase shift on a line including an antenna unit is not accurately detected.

SUMMARY

According to one aspect of the invention there is provided a radio communication apparatus including: a first antenna, a second antenna, and a third antenna; and a processor configured to perform a procedure including: varying a phase difference between a first signal transmitted from the first antenna and a second signal transmitted from the second antenna, measuring a received power pattern of a synthesized signal of the first signal and the second signal, the synthesized signal being received by the third antenna, and adjusting a phase shift of a signal that is transmitted from the first antenna or the second antenna, based on a difference between the measured received power pattern and a received power pattern obtained by calculation.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 10 illustrates an example of phase information according to the second embodiment;

DESCRIPTION OF EMBODIMENTS

Figure 1:
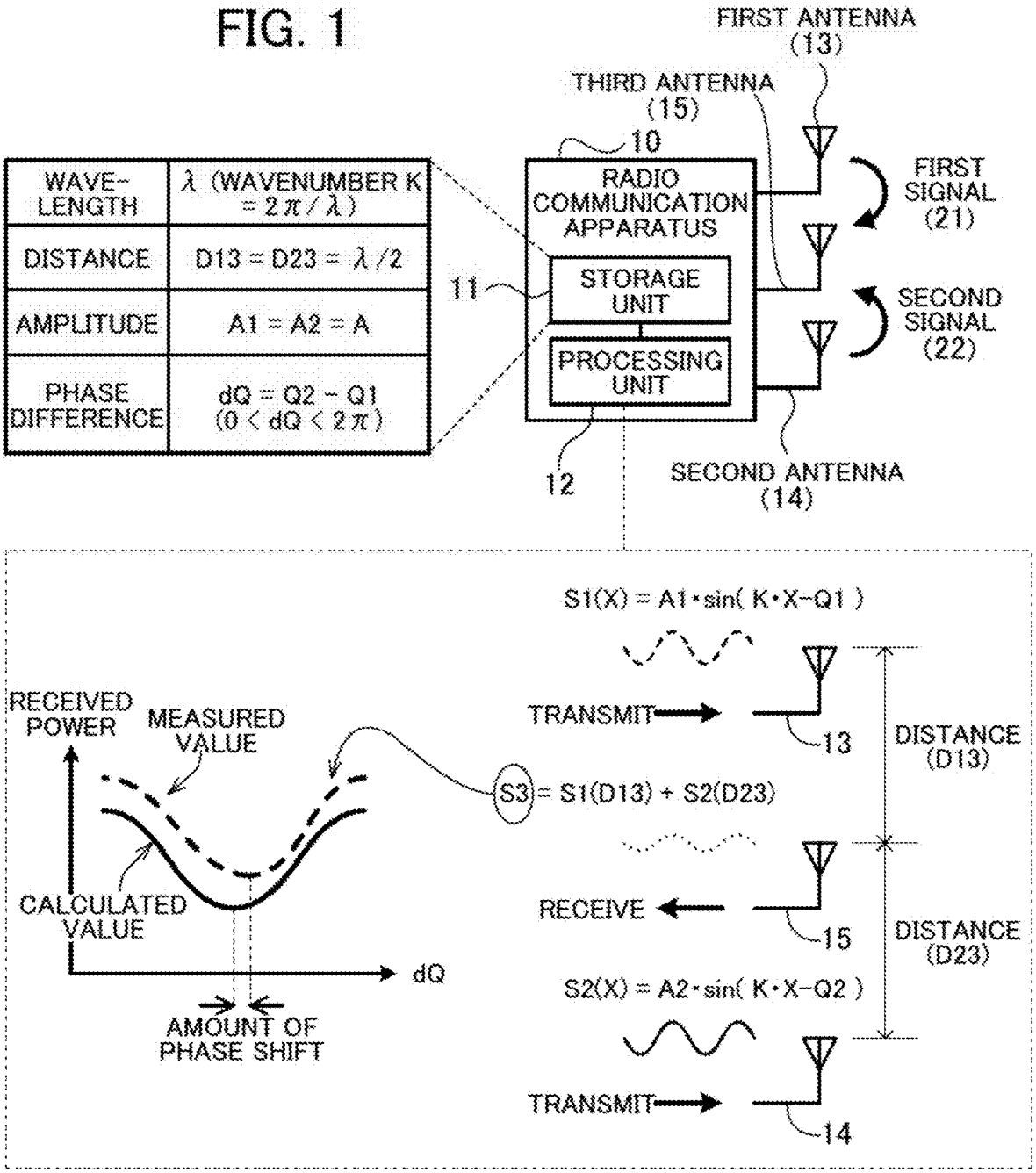
FIG. 1 illustrates an example of a radio communication apparatus according to a first embodiment.

Hereinafter, several embodiments will be described with reference to the accompanying drawings. Like reference numerals refer to like elements throughout, and a description of like elements will not be repeated.

(1) First Embodiment

A first embodiment will be described with reference to FIG. 1. The first embodiment relates to a method of measuring, in a radio communication apparatus that transmits signals using a plurality of antennas, a phase shift that occurs to a signal after phase adjustment on the lines including the antennas, and adjusts the phase of the signal to reduce the phase shift. FIG. 1 illustrates an example of a radio communication apparatus according to the first embodiment.

As illustrated in FIG. 1, a radio communication apparatus 10 includes a storage unit 11, a processing unit 12, a first antenna 13, a second antenna 14, and a third antenna 15.

The storage unit 11 is a volatile storage device such as a random access memory (RAM) and the like, or a non-volatile storage device such as a hard disk drive (HDD), a flash memory, and the like. The processing unit 12 is a processor such as a central processing unit (CPU), a digital signal processor (DSP), an application specific integrated circuit (ASIC), a field programmable gate array (FPGA), and the like.

The storage unit 11 stores information on a wavelength λ (wavenumber K=2π/λ) of a first signal 21 transmitted from the first antenna 13 and a second signal 22 transmitted from the second antenna 14. The storage unit 11 also stores a distance D13 between the first antenna 13 and the third antenna 15, and a distance D23 between the second antenna 14 and the third antenna 15. The storage unit 11 also stores an amplitude A1 of the first signal 21, and an amplitude A2 of the second signal 22.

The wavelength λ, the distances D13 and D23, and the amplitudes A1 and A2 are determined in advance. In the example of FIG. 1, both the distances D13 and D23 are set to a half wavelength (λ/2). The amplitudes A1 and A2 are set to a same value A.

The processing unit 12 generates the first signal 21 and the second signal 22 based on the information in the storage unit 11, transmits the first signal 21 from the first antenna 13, and transmits the second signal 22 from the second antenna 14. For example, the processing unit 12 generates the first signal 21 by shifting the phase of a carrier wave having the wavelength λ and the amplitude A by Q1. Further, the processing unit 12 generates the second signal 22 by shifting the phase of the carrier wave by Q2.

Information on the amounts Q1 and Q2 by which the phase is shifted may be stored in advance in the storage unit 11. For example, the storage unit 11 stores the predetermined value of Q1 (for example, 0) and the value of a phase difference dQ (dQ=Q2−Q1; 0<dQ<2π) which is the difference between Q1 and Q2.

The processing unit 12 changes the phase difference dQ between the first signal 21 and the second signal 22 based on the information in the storage unit 11. The first signal 21 transmitted from the first antenna 13 and second signal 22 transmitted from the second antenna 14 are received by the third antenna 15.

For example, when the first signal 21 is S1 (see equation (1) below) and the second signal 22 is S2 (see equation (2) below), a synthesized signal S3 of S1 and S2 at the third antenna 15 is given by equation (3) below.

$$S1(X)=A1\cdot\sin(K\cdot X-Q1) \tag{1}$$

$$S2(X)=A2\cdot\sin(K\cdot X-Q2) \tag{2}$$

$$S3=S1(D13)+S2(D23) \tag{3}$$

Here, when A1=A2=A; D13=D23=λ/2; and Q1=Q, the synthesized signal S3 is expressed by equation (4) below, where R is an attenuation coefficient. In this case, when dQ is 0, S3 is maximized. That is, when dQ is 0, the first signal 21 and the second signal 22 have the same phase at the third antenna 15 and reinforce each other. On the other hand, when dQ is π, S3 is minimized. That is, when dQ is π, the first signal 21 and the second signal 22 have opposite phases at the third antenna 15 and cancel each other out.

$$\begin{aligned} S3 &= R\cdot A\cdot\{\sin(K\cdot\lambda/2-Q)+\sin(K\cdot\lambda/2-(dQ+Q))\} \\ &= R\cdot A\cdot\{\sin(\pi-Q)+\sin(\pi-Q-dQ)\} \end{aligned} \tag{4}$$

The processing unit 12 measures a received power pattern in the case where the synthesized signal of the first signal 21 and the second signal 22 is received by the third antenna 15. Then, the processing unit 12 calculates the amount of the phase shift based on the difference between the measured receiving power pattern (dQ—dashed line in the received power graph) and a received power pattern (dQ—solid line in the received power graph) obtained by calculation.

As described above, the phases of the first signal 21 and the second signal 22 are adjusted by the processing unit 12. However, if there are secular changes in the path to a point where the first signal 21 is output via the first antenna 13, a shift in the phase (a phase shift) may occur to the first signal 21 that is output. Similarly, a phase shift may also occur to the second signal 22.

If there is such a phase shift in at least one of the first signal 21 and second signal 22, the synthesized signal S3 resulting from the interring first signal 21 and second signal 22 has a waveform different from that of the case where there is no phase shift. Accordingly, it is possible to calculate the amount of the phase shift by comparing the measured value with the calculated value of the synthesized signal S3 and analyzing the difference. Comparing the received power patterns is one of the methods for calculating the amount of the phase shift.

In the above example, according to calculation using the above equation (4), S3 is minimized when dQ is $\pi$. Meanwhile, when there is a phase shift in at least one of the first signal 21 and the second signal 22, the phase difference dQ that minimizes S3 in the received power pattern obtained from the measured value of S3 is shifted from $\pi$. This difference in the phase difference dQ is the difference between the originally expected phase difference between the signal transmitted from the first antenna 13 and the signal transmitted from the second antenna 14 and the actual phase difference.

The processing unit 12 adjusts the phase of the signal transmitted from the first antenna 13 or the signal transmitted from the second antenna 14 so as to cancel out the difference in the phase difference dQ. With this adjustment, it is possible to reduce the phase shift caused by secular changes in the path described above.

As described above, by comparing the calculated value with the actual value of the received power pattern of the synthesized signal, it is possible to calculate the amount of the phase shift. Although comparison of dQ is made at the point where S3 is minimized in the above example, comparison of dQ may be made at the point where S3 is maximized.

Further, in the above embodiment, the first antenna 13 and the second antenna 14 are used as transmitting antennas, and the third antenna 15 adjacent to these two transmitting antennas are used as a receiving antenna. With this antenna configuration, it is not possible to perform phase adjustment between the adjacent antennas. Thus, the configuration of the transmitting antennas and the receiving antenna may be changed. For example, the first antenna 13 and the third antenna 15 may be used as transmitting antennas, and the second antenna 14 may be used as a receiving antenna. In this case as well, it is possible to calculate the amount of the phase shift in the same manner as described above.

The technique according to the first embodiment is applicable not only to a radio communication apparatus having a flat antenna such as a patch antenna and the like, but also to a radio communication apparatus having an antenna array of pole antennas. Further, in the above example, a radio communication apparatus having three antennas has been described for purposes of explanation. However, the antenna array may include four or more antennas.

The above is a description of the first embodiment.

(2) Second Embodiment

The following describes a second embodiment. The second embodiment relates to a method of measuring, in a radio communication apparatus that transmits signals using a plurality of antennas, a phase shift that occurs to a signal after phase adjustment on the lines including the antennas, and adjusts the phase of the signal to reduce the phase shift.

(2-1) Phase Shift

Figure 2:
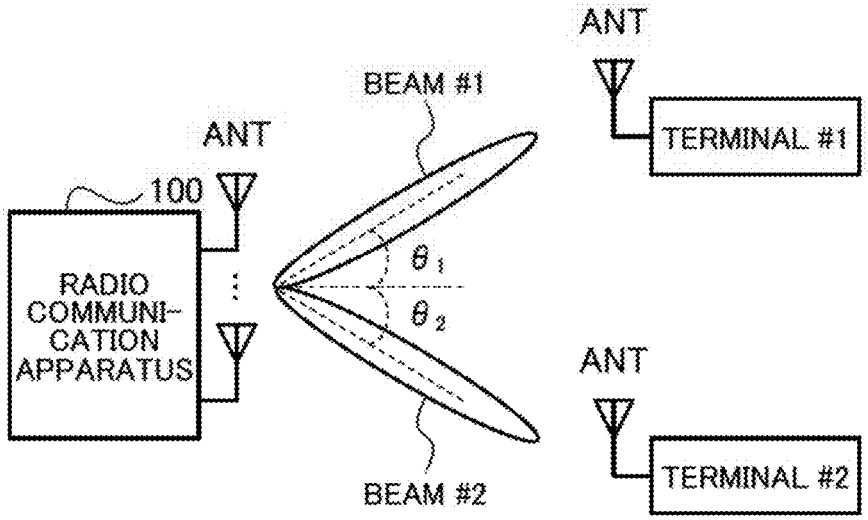
FIG. 2 illustrates an example of a radio communication system according to a second embodiment.

Hereinafter, a radio communication apparatus 100 having a plurality of antennas (ANTs) illustrated in FIG. 2 will be described by way of example. FIG. 2 illustrates an example of a radio communication system according to the second embodiment.

Radio technologies that use a plurality of antennas include, for example, multiple-input and multiple-output (MIMO) and beamforming (BF). In both technologies, the accuracy in controlling the amplitude and the phase of the signal transmitted from each antenna greatly affects the communication performance.

For example, in the case of beamforming, as illustrated in FIG. 2, the radio communication apparatus 100 switches the direction of the beam by controlling the amplitude and the phase of the signal transmitted from each antenna. In the example of FIG. 2, a terminal #1 is located in the direction of $\theta_1$, and a terminal #2 is located in the direction of $\theta_2$.

In the case of transmitting a signal to the terminal #1, the radio communication apparatus 100 directs a beam (beam #1) in the direction of $\theta_1$, and directs NULL (a part where the signals transmitted from the plurality of antennas cancel each other out) in the direction of $\theta_2$. On the other hand, in the case of transmitting a signal to the terminal #2, the radio communication apparatus 100 directs a beam (beam #2) in the direction of $\theta_2$, and directs NULL in the direction of $\theta_1$.

In this manner, by performing beamforming, it is possible to improve the spatial multiplicity. As a result, it is expected to achieve the effects of improving the frequency usage efficiency and the like. However, if the phase of the signal transmitted from each antenna is deviated from the value of the intended phase, both the direction of the beam and the direction of NULL are deviated from their intended directions. This may result in occurrence of a reception error, and an increase in interference.

The phase of the signal transmitted from each antenna is deviated from the intended phase due to, for example, secular changes in a signal line including a feed line extending from the phase shifter to the antenna and a signal line including the antenna. Usually, each phase shifter is appropriately adjusted in a check process before shipment of the radio communication apparatus 100. However, the length of the signal line changes with the passage of time. Therefore, a phase shift corresponding to the change occurs, which causes a deviation of the beam from the intended direction.

In the following, a description will be given of a mechanism that detects the phase shift described above, and adjusts the phase of the signal transmitted from each antenna to reduce the detected phase shift. For convenience of explanation, a radio communication system that performs beamforming will be described by way of example.

(2-2) Radio Communication Apparatus

Figure 3:
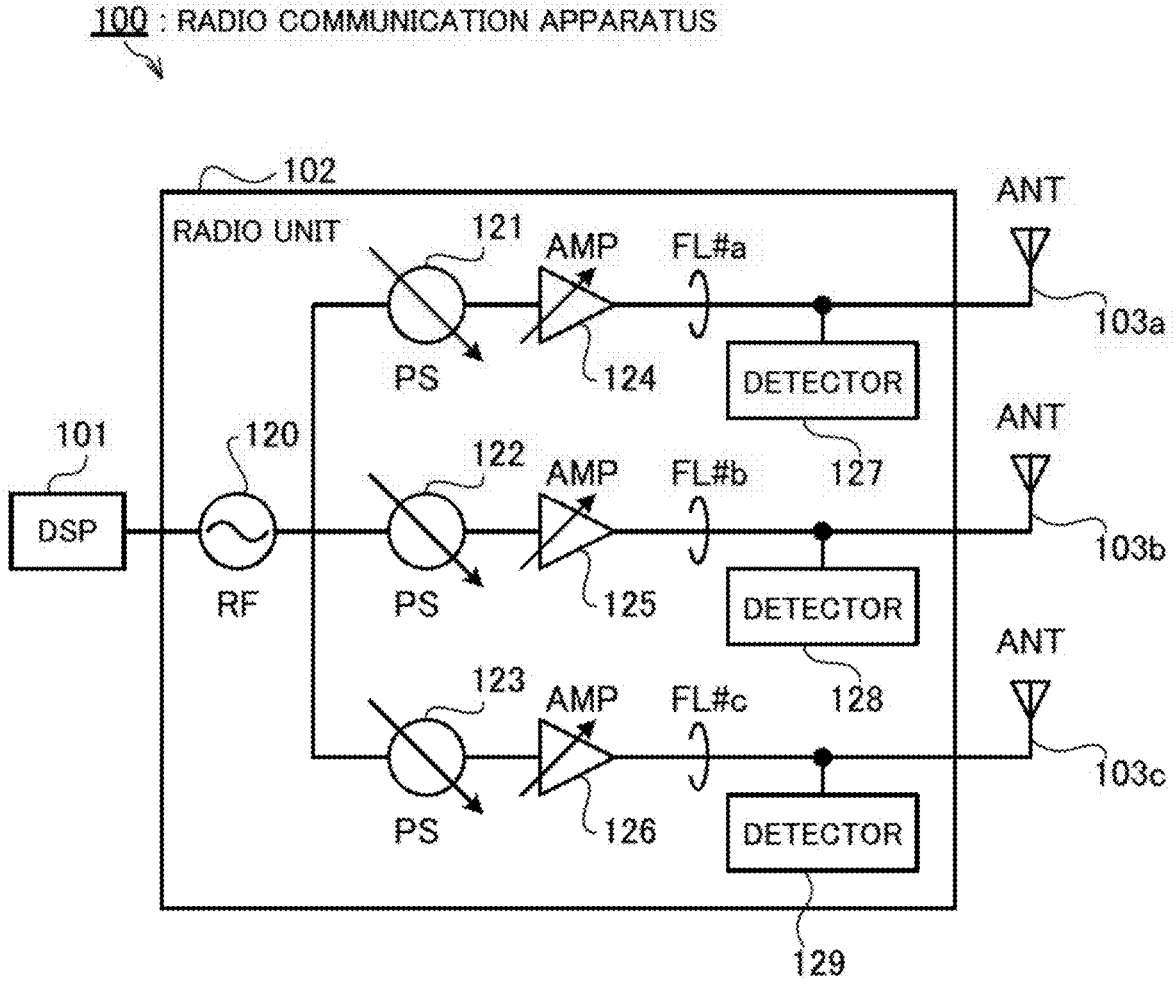
FIG. 3 illustrates an example of a radio communication apparatus according to the second embodiment.

First, the radio communication apparatus 100 will be further described with reference to FIG. 3. FIG. 3 illustrates an example of a radio communication apparatus according to the second embodiment.

(Main Elements)

As illustrated in FIG. 3, the radio communication apparatus 100 includes a DSP 101, a radio unit 102, and antennas (ANTs) 103*a*, 103*b*, and 103*c*. For convenience of explanation, three antennas are illustrated. However, the radio communication apparatus 100 may include four or more antennas.

The DSP 101 is a processor that processes a baseband signal in the digital domain. The radio unit 102 converts a digital baseband signal output from the DSP 101 into an analog baseband signal, and performs band conversion to convert the baseband signal into an RF signal. Further, the radio unit 102 adjusts the amplitude and the phase of the RF signal in accordance with the direction of the beam to be formed, and transmits the RF signal from the antennas 103*a*, 103*b*, and 103*c*. Note that, when receiving the signal, these operations are performed in reverse order. Further, the radio unit 102 has a function of detecting the phase shift described above.

The radio unit 102 includes an RF processing unit 120, phase shifters (PSs) 121, 122, and 123, amplifiers (AMPS) 124, 125, and 126, and detectors 127, 128, and 129.

The RF processing unit 120 performs analog-to-digital and digital-to-analog (AD and DA) conversion processing between an analog baseband signal and a digital baseband signal, and performs frequency conversion processing that converts an analog baseband signal into an RF signal. The RF processing unit 120 is connected to the phase shifters 121, 122, and 123.

The phase shifter 121 and the amplifier 124 are disposed on a signal line connecting the RF processing unit 120 and the antenna 103*a*. The signal line extending from the amplifier 124 to the antenna 103*a* may be hereinafter referred to as a feedline FL #a. The detector 127 is connected to the feedline FL #a. The phase shifter 121 adjusts the phase of an RF signal. The amplifier 124 adjusts the amplitude of an RF signal. The adjustment values of the amplitude and the phase are controlled by the DSP 101.

The detector 127 detects the voltage (detected voltage) of a signal received via the antenna 103*a*. For example, the detected voltage is reported from the detector 127 to the DSP 101. The DSP 101 detects a phase shift based on the detected voltage reported from the detector 127. Further, the DSP 101 adjusts the phase to reduce the detected phase shift. The detected voltage may be converted into a received power of the signal (that is, the detected voltage corresponds to the received power of the signal).

The phase shifter 122 and the amplifier 125 are disposed on a signal line connecting the RF processing unit 120 and the antenna 103*b*. The phase shifter 123 and the amplifier 126 are disposed on a signal line connecting the RF processing unit 120 and the antenna 103*c*. The signal line extending from the amplifier 125 to the antenna 103*b* may be hereinafter referred to as a feedline FL #b, and the signal line extending from the amplifier 126 to the antenna 103*c* may be hereinafter referred to as a feedline FL #c.

The detector 128 is connected to the feedline FL #b. The detector 129 is connected to the feedline FL #c. Similar to the phase shifter 121, the phase shifters 122 and 123 adjust the phase of an RF signal. Similar to the amplifier 124, the amplifiers 125 and 126 adjust the amplitude of an RF signal. The detector 128 detects the voltage (detected voltage) of a signal received via the antenna 103*b*. The detector 129 detects the voltage (detected voltage) of a signal received via the antenna 103*c*.

Similar to the detector 127, the detectors 128 and 129 report the detected voltage to the DSP 101. The DSP 101 detects a phase shift based on the detected voltage reported from each of the detectors 128 and 129. Further, the DSP 101 adjusts the phase to reduce the detected phase shift (phase adjustment). The method of phase adjustment will be described below.

(Example of Antennas)

Hereinafter, an example in which flat antennas (patch antennas) are used as the antennas 103*a*, 103*b*, and 103*c* will be described with reference to FIG. 4. The element that implements the functions of the antennas 103*a*, 103*b*, and 103*c* may be referred to as an antenna unit.

Figure 4:
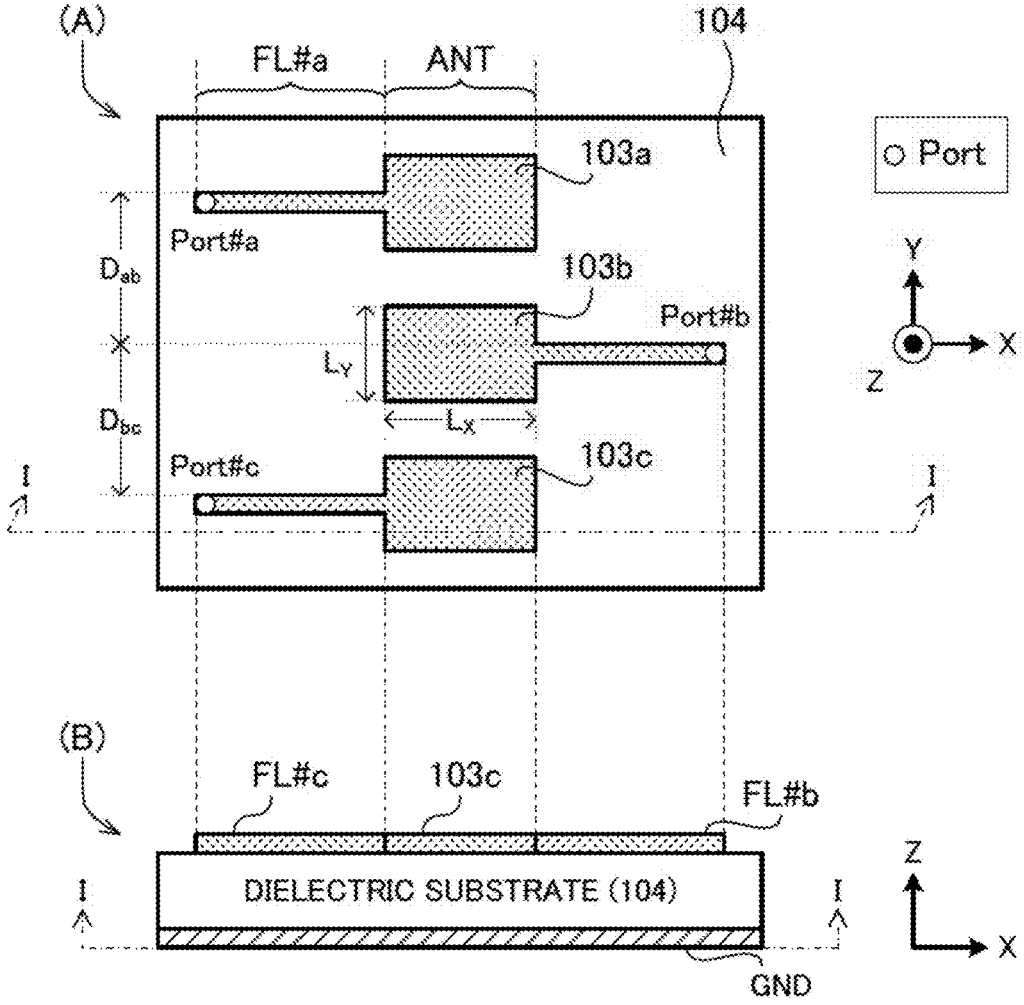
FIG. 4 illustrates an example of an antenna unit (flat antennas) according to the second embodiment.

FIG. 4 illustrates an example of an antenna unit (flat antennas) according to the second embodiment. More specifically, (A) of FIG. 4 is a top view of the antenna unit, and (B) is a cross-sectional view of the antenna unit taken along line I-I.

Hatched areas in (A) of FIG. 4 represent conductors (metal material or the like). As illustrated in (B) of FIG. 4, the conductors are disposed on the top surface of a dielectric substrate 104. A conductor plate that serves as ground (GND) is disposed on the bottom surface of the dielectric substrate 104.

The conductors disposed on the top surface of the dielectric substrate 104 include rectangular portions with a length of $L_X$ in the X direction and a length of $L_Y$ in the Y direction that serve as antennas (antennas 103*a*, 103*b*, and 103*c*). The interval between the antennas 103*a* and 103*b* is set to $D_{ab}$. The interval between the antennas 103*b* and 103*c* is set to $D_{bc}$.

The conductors disposed on the top surface of the dielectric substrate 104 also include portions extending from the rectangular portions to the ports (Port #a, Port #b, and Port #c). These portions form at least parts of the feed lines FL #a, FL #b, and FL #c. For example, Port #a is connected to a signal line connected to the amplifier 124, and the signal line is connected to the detector 127. A similar description applies to Port #b and Port #c.

Hereinafter, the antenna unit of FIG. 4 will be described by way of example.

(Phase Adjustment Method)

Figure 5:
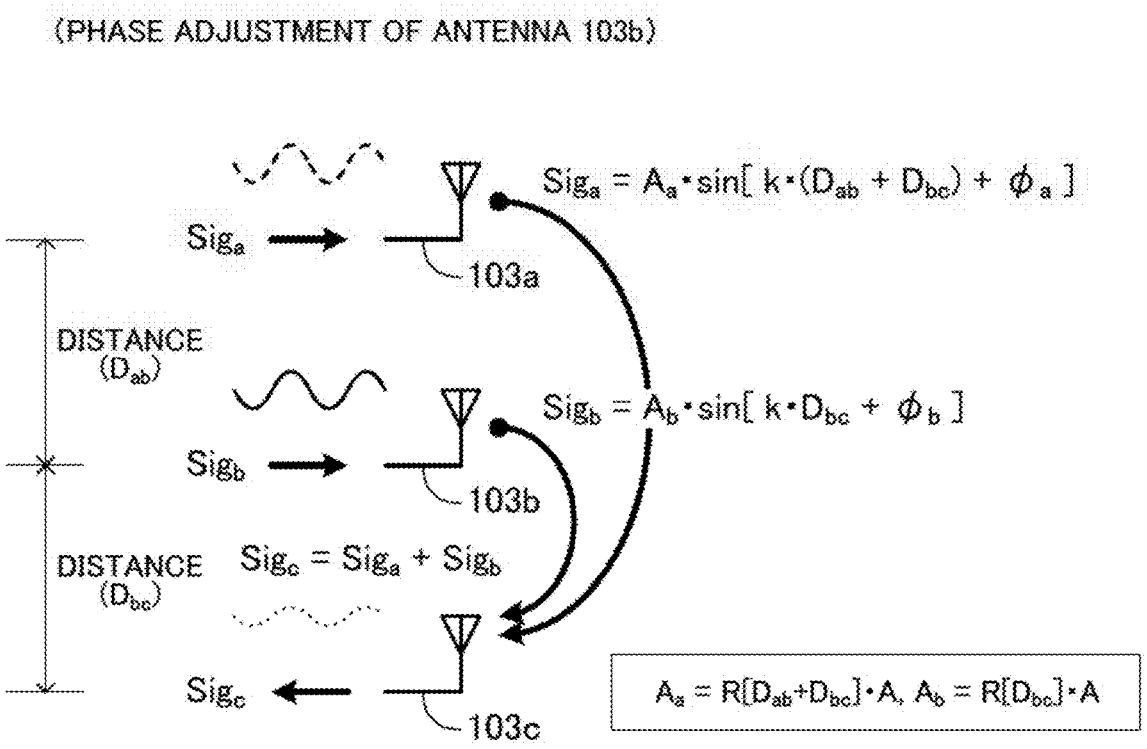
FIG. 5 illustrates an example of the arrangement of antennas used for phase adjustment and a synthesized signal (an example of a case where one transmitting antenna is adjacent to a receiving antenna) according to the second embodiment.

Hereinafter, a phase adjustment method according to the second embodiment will be described with reference to FIG. 5. FIG. 5 illustrates an example of the arrangement of antennas used for phase adjustment and a synthesized signal (an example of a case where one transmitting antenna is adjacent to a receiving antenna) according to the second embodiment.

In the phase adjustment according to the second embodiment, two of the antennas 103*a*, 103*b*, and 103*c* are used as transmitting antennas, and one is used as a receiving antenna. In the example of FIG. 5, the antennas 103*a* and 103*b* are used as transmitting antennas, and the antenna 103*c* is used as a receiving antenna.

The distance $D_{ab}$ between the antennas 103*a* and 103*b* and the distance $D_{bc}$ between the antennas 103*b* and 103*c* are known. The amplitude A of the signals ($Sig_a$ and $Sig_b$) transmitted from the antennas 103*a* and 103*b* may be controlled by the amplifiers 124 and 125. The phases $\varphi_a$ and (Pb of the signals ($Sig_a$ and $Sig_b$) transmitted from the antennas 103*a* and 103*b* may be controlled by the phase shifters 121 and 122. For convenience of explanation, the amplitudes of the signals $Sig_a$ and $Sig_b$ have the same value A.

When the wavenumber of the RF signal output from the RF processing unit 120 is k ($k=2\pi/\lambda$; $\lambda$ represents the wavelength), the signal $Sig_a$ transmitted from the antenna 103*a* may be expressed by equation (5) below. Further, the signal $Sig_b$ transmitted from the antenna 103*b* may be expressed by equation (6) below, where λ represents the distance from the antenna.

$$Sig_a(\lambda)=A\cdot\sin[k\cdot X+\varphi_a] \quad (5)$$

$$Sig_b(X)=A\cdot\sin[k\cdot X+\varphi_b] \quad (6)$$

A signal $Sig_c$ received by the antenna 103*c* is a synthesized signal of the signals $Sig_a$ and $Sig_b$ at the antenna 103*c*. Therefore, the signal $Sig_c$ may be expressed by equation (7) below, using the attenuation coefficient R[D] dependent on the distance D.

$$\begin{aligned} Sig_c &= Sig_a(D_{ab}+D_{bc})+Sig_b(D_{bc}) \\ &= A_a\cdot\sin[k\cdot(D_{ab}+D_{bc})+\varphi_a]+A_b\cdot\sin[k\cdot D_{bc}+\varphi_b] \end{aligned} \quad (7)$$

$$(\text{where } A_a = R[D_{ab}+D_{bc}]\cdot A,\ A_b = R[D_{bc}]\cdot A)$$

Figure 6:
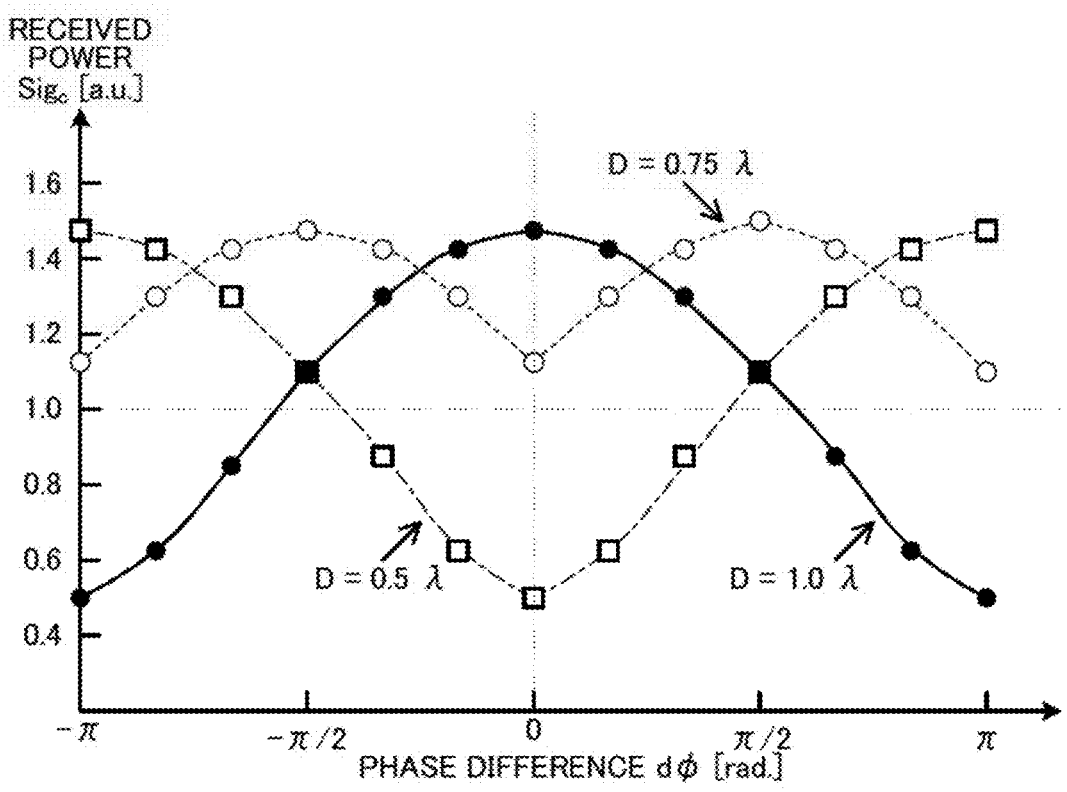
FIG. 6 illustrates the relationship between the received power of a synthesized signal and the phase difference.

When $D_{ab}=D_{bc}=D$; $A_a=R[2D]\cdot A=0.5$; $A_b=R[D]\cdot A=1.0$; and $d\varphi=\varphi_b-\varphi_a$, if changes in $Sig_c$ (received power) associated with changes in phase difference dφ are calculated under three conditions: D=0.5λ, D=0.75λ, and D=1.0λ, the graph of FIG. 6 is obtained. FIG. 6 illustrates the relationship between the received power of a synthesized signal and the phase difference. The unit of the vertical axis is an arbitrary unit (a.u.), and the unit of the horizontal axis is radian (rad.).

The solid line corresponds to the condition that D=1.0λ. Under this condition, when the phase difference dφ is 0, the received power is maximized. That is, when the phase difference dφ is 0, the signals $Sig_a$ and $Sig_b$ have the same phase at the position of the antenna 103*c*, indicating that the two signals reinforce each other.

The one-dot chain line corresponds to the condition that D=0.5λ. Under this condition, when the phase difference dφ is 0, the received power is minimized. That is, when the phase difference dφ is 0, the signals $Sig_a$ and $Sig_b$ have opposite phases at the position of the antenna 103*c*, indicating that the two signals cancel each other out. The graph indicated by the chain line is obtained under the condition that D=0.75λ.

As described above, it is possible to calculate the phase difference dφ that maximizes the received power or minimizes the received power, based on the known information (the antenna interval D and the wavelength λ). If the phase shift described above is not generated, the measured value of the phase difference dφ that maximizes or minimizes the received power matches the calculated value from equation (7). On the other hand, if the phase shift described above is generated, there is a difference between the measured value and the calculated value. This difference is the magnitude of the phase shift.

Figure 7:
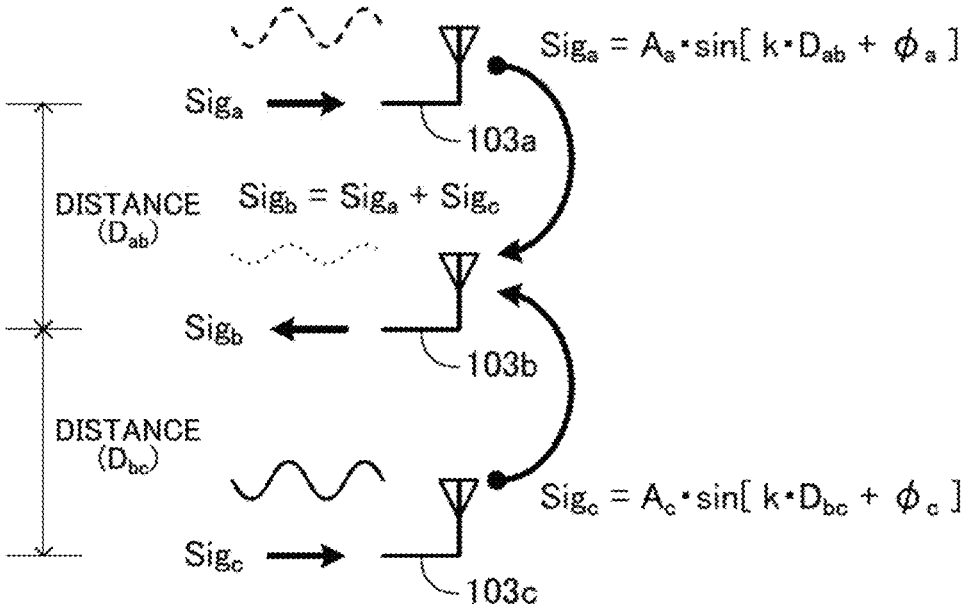
FIG. 7 illustrates an example of the arrangement of antennas used for phase adjustment and a synthesized signal (an example of a case where two transmitting antennas are adjacent to a receiving antenna) according to the second embodiment.

In the case where the antennas 103*a* and 103*c* are used as transmitting antennas and the antenna 103*b* is used as a receiving antenna (see FIG. 7), the signal $Sig_b$ received at the antenna 103*b* may be expressed by equation (8). FIG. 7 illustrates an example of the arrangement of antennas used for phase adjustment and a synthesized signal (an example of a case where two transmitting antennas are adjacent to a receiving antenna) according to the second embodiment. Here, $\varphi_c$ is the phase of the signal $Sig_c$ controlled by the phase shifter 123. The amplitudes of the signals $Sig_a$ and $Sig_c$ have the same value A.

$$\begin{aligned} Sig_b &= Sig_a(D_{ab})+Sig_b(D_{bc}) \\ &= A_a\cdot\sin[k\cdot D_{ab}+\varphi_a]+A_c\cdot\sin[k\cdot D_{bc}+\varphi_c] \end{aligned} \quad (8)$$

$$(\text{where } A_a = R[D_{ab}]\cdot A,\ \text{and } A_c = R[D_{bc}]\cdot A)$$

In the example of FIG. 5, the detector 129 detects $Sig_c$. In the example of FIG. 7, the detector 128 detects $Sig_b$. The phase shift determined from the detection result of $Sig_c$ is generated on at least one of the two feed lines FL #a and FL #b. Then, by adjusting (shifting) the phase controlled by the phase shifter 121 or 122 by the amount of the determined phase shift, it is possible to reduce the phase shift. Here, the phase of the signal transmitted from the antenna 103*a* is used as a reference. In this case, the phase of the phase shifter 122 is adjusted.

Similarly, the phase shift determined from the detection result of $Sig_b$ is generated on at least one of the two feed lines FL #a and FL #c. Then, by adjusting (shifting) the phase controlled by either one of the phase shifters 121 and 123 by the amount of the determined phase shift, it is possible to reduce the phase shift. In the case where the phase of the signal transmitted from the antenna 103*a* is used as a reference, the phase of the phase shifter 123 is adjusted.

By adjusting the phases of the phase shifters 122 and 123 using the method described above, it is possible to reduce the phase shift caused by secular changes in the feed lines FL #a, FL #b, and FL #c.

(Function for Phase Adjustment)

Figure 8:
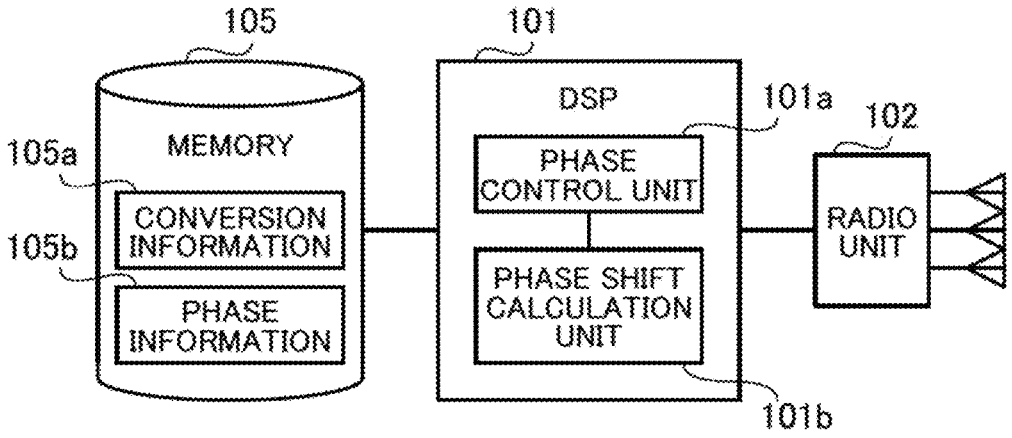
FIG. 8 illustrates an example of functions of the radio communication apparatus according to the second embodiment.

In the following, the functions provided by the radio communication apparatus 100 will be further described with reference to FIG. 8. FIG. 8 illustrates an example of functions of the radio communication apparatus according to the second embodiment.

As mentioned above, the radio communication apparatus 100 detects a phase shift using the antennas 103*a*, 103*b*, and 103*c*, and reduces the phase shift by adjusting the phase of the signal. This function for phase adjustment is implemented mainly by control performed by the DSP 101. As illustrated in FIG. 8, the radio communication apparatus 100 further includes a memory 105 such as a RAM, a ROM, a flash memory, and the like. The DSP 101 may refer to the content of the memory 105.

The memory 105 stores conversion information 105*a* and phase information 105*b*.

Figure 9:
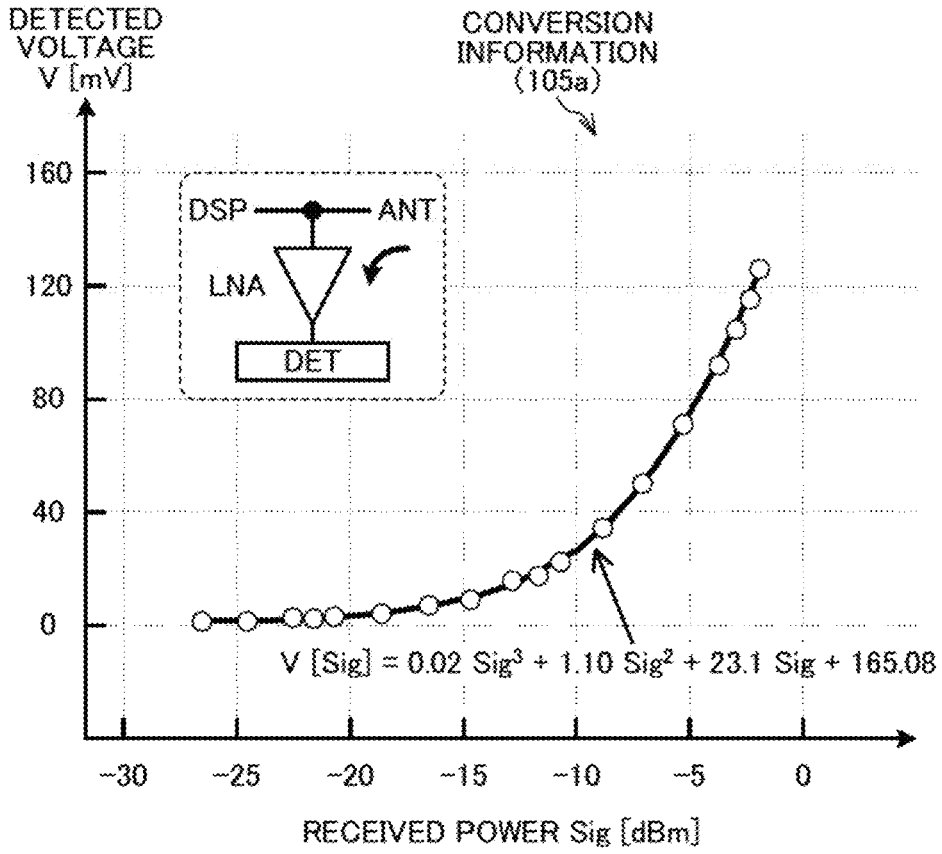
FIG. 9 illustrates an example of conversion information according to the second embodiment.

As illustrated in FIG. 9, the conversion information 105*a* is information for converting the voltage (detected voltage) detected by the detectors 127, 128, and 129 upon reception of a synthesized signal into a received power. FIG. 9 illustrates an example of conversion information according to the second embodiment. For convenience of explanation, in FIG. 9, a graph representing the relationship between a received power Sig and a detected voltage V is illustrated. However, the conversion information 105*a* may be expressed by an equation V[Sig] that represents the graph of FIG. 9, or a conversion table indicating the corresponding relationship between the detected voltage and the received power.

As illustrated in FIG. 10, the phase information 105*b* is information indicating the adjustment value (shift amount) for the phase that is adjusted based on the detection result of the phase shift. FIG. 10 illustrates an example of phase information according to the second embodiment. In the example of FIG. 10, the adjustment value of the phase in the phase shifter (PS) 122 is set to $d\varphi_b$, and the adjustment value of the phase in the phase shifter 123 is set to $d\varphi_c$. The content of the phase information 105*b* is updated when the phase shift is calculated.

The DSP 101 includes a phase control unit 101*a* and a phase shift calculation unit 101*b*. The phase control unit 101*a* controls the phase shifters 121, 122, and 123 to control the phase of the signals transmitted from the antennas 103*a*, 103*b*, and 103*c*.

The phase shift calculation unit 101*b* determines two transmitting antennas and a receiving antenna when performing the phase adjustment described above. The phase shift calculation unit 101*b* controls the phase difference $d\varphi$ of the signals transmitted from the two transmitting antennas. Further, the phase shift calculation unit 101*b* calculates the amount of the phase shift (phase shift amount) from the received power of the synthesized signal received by the receiving antenna, and updates the phase information 105*b* based on the calculation results.

In the example of FIG. 5 (example where the phase of the phase shifter 122 corresponding to the antenna 103*b* is adjusted with respect to the phase of the signal transmitted from the antenna 103*a*), the phase shift calculation unit 101*b* determines the antennas 103*a* and 103*b* as transmitting antennas. Further, the phase shift calculation unit 101*b* determines the antenna 103*c* as a receiving antenna. Then, the phase shift calculation unit 101*b* monitors changes in the detected voltage reported from the detector 129, while varying the phase difference $d\varphi$ ($d\varphi=\varphi_b-\varphi_a$) between the signals $Sig_a$ and $Sig_b$.

Figure 11:
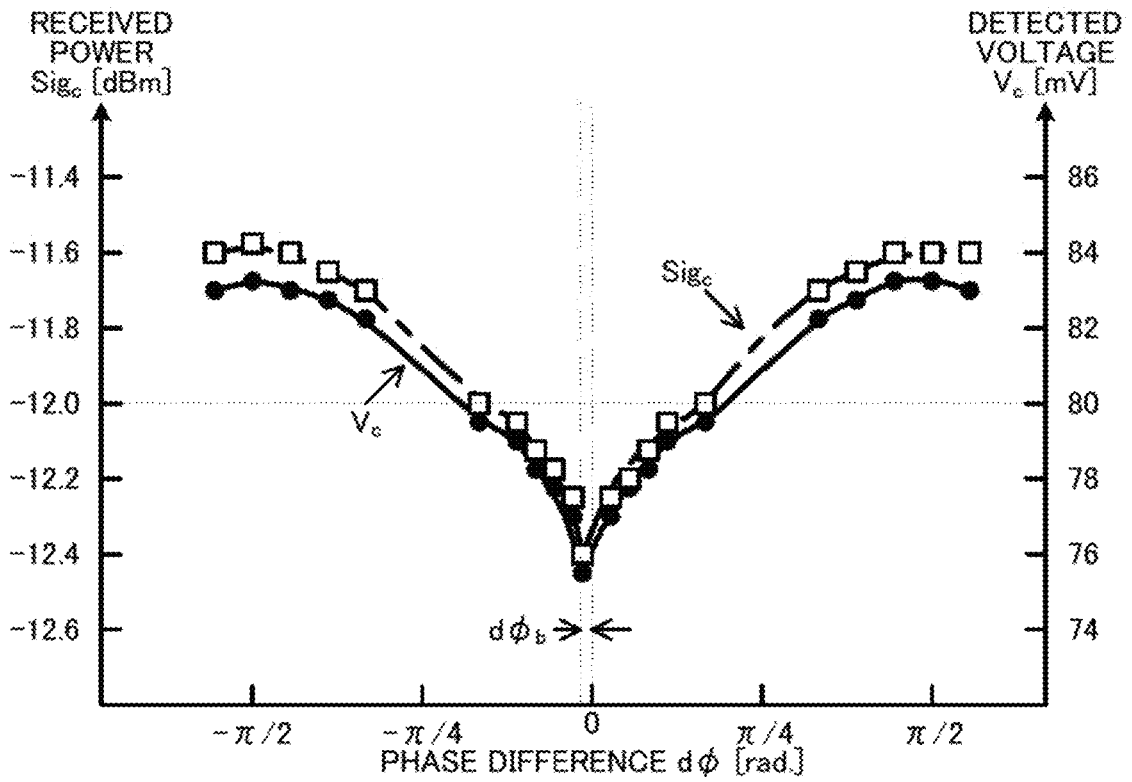
FIG. 11 illustrates the results of simulation under a specific condition (condition #1)

Under the condition (condition #1) where $Sig_a$ and $Sig_b$ have opposite phases at the position of the antenna 103*c* when the phase difference $d\varphi$ is 0, the detected voltage (received power with detector 129) changes along with the changes in the phase difference $d\varphi$ as illustrated in FIG. 11. FIG. 11 illustrates the results of simulation under the specific condition (condition #1). The solid line represents the graph of the detected voltage, and the one-dot chain line represents the graph of the received voltage obtained by converting the graph of the detected voltage using the conversion information 105*a* (see FIG. 9).

In this case, the phase shift calculation unit 101*b* determines the value of the phase difference $d\varphi$ that minimizes the detected voltage (or the received power) from the graph. Further, the phase shift calculation unit 101*b* calculates a difference $d\varphi_b$ (phase shift amount) between the determined value (measured value) and the value of the phase difference $d\varphi$ (calculated value; 0 in this example) that minimizes the value on the graph based on the calculation. Then, the phase shift calculation unit 101*b* writes the calculated $d\varphi_b$ to the phase information 105*b*, in association with information on the phase shifter 122.

Figure 12:
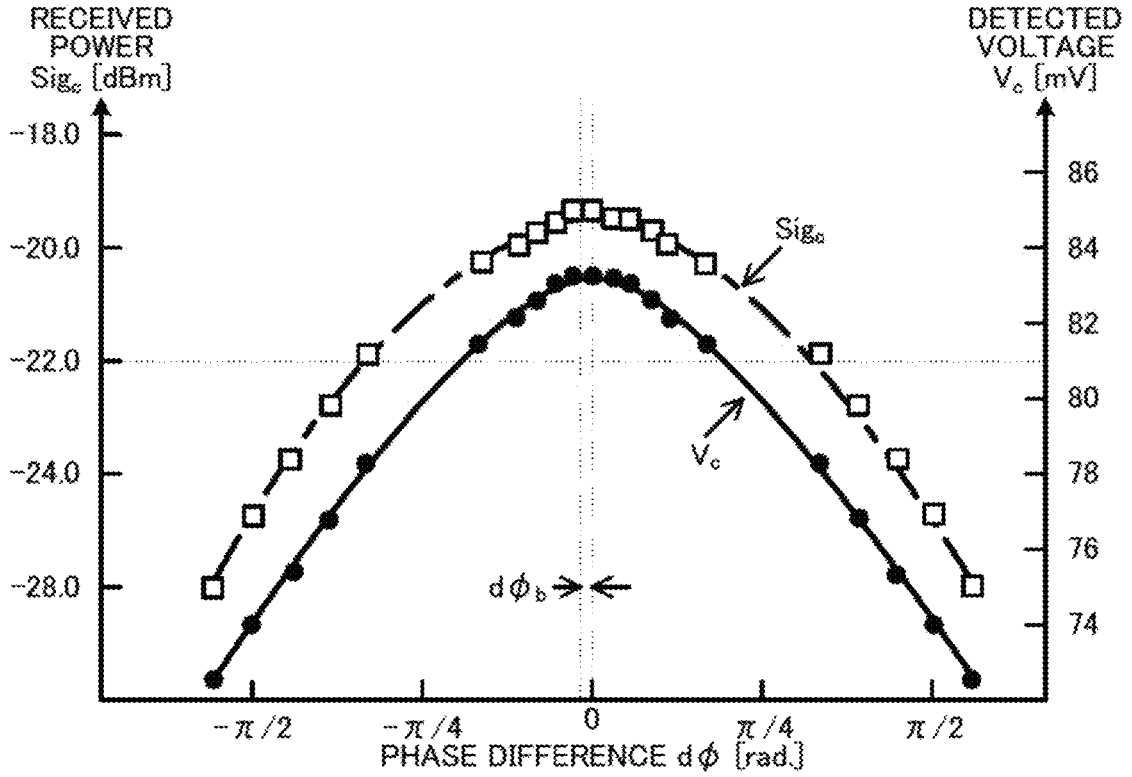
FIG. 12 illustrates the results of simulation under a specific condition (condition #2)

In another example, under the condition (condition #2) where $Sig_a$ and $Sig_b$ have the same phase at the position of the antenna 103*c* when the phase difference $d\varphi$ is 0, the detected voltage (received power with detector 129) changes along with the changes in the phase difference $d\varphi$ as illustrated in FIG. 12. FIG. 12 illustrates the results of simulation under the specific condition (condition #2).

As still another example, in the example of FIG. 7 (example where the phase of the phase shifter 123 corresponding to the antenna 103*c* is adjusted with respect to the phase of the signal transmitted from the antenna 103*a*), the phase shift calculation unit 101*b* determines the antennas 103*a* and 103*c* as transmitting antennas. Further, the phase shift calculation unit 101*b* determines the antenna 103*b* as a receiving antenna. Then, the phase shift calculation unit 101*b* monitors changes in the detected voltage reported from the detector 128, while varying the phase difference $d\varphi$ ($d\varphi=\varphi_c-\varphi_a$) between the signals $Sig_a$ and $Sig_c$.

Figure 13:
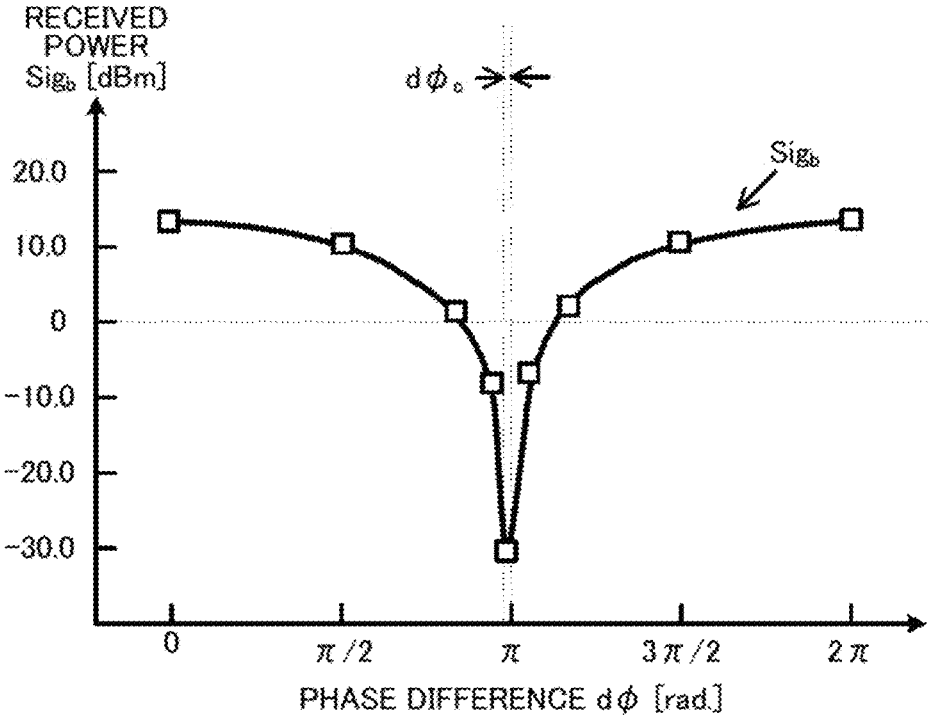
FIG. 13 illustrates the results of simulation under a specific condition (condition #3)

Under the condition (condition #3) where $Sig_a$ and $Sig_c$ have opposite phases at the position of the antenna 103*c* when the phase difference $d\varphi$ is 0, the detected voltage (received power with detector 128) changes along with changes in the phase difference $d\varphi$ as illustrated in FIG. 13. FIG. 13 illustrates the results of simulation under the specific condition (condition #3). In this case, the phase shift calculation unit 101*b* determines the value of the phase difference $d\varphi$ that minimizes the detected voltage (or the received power) from the graph.

Further, the phase shift calculation unit 101*b* calculates a difference $d\varphi_c$ (phase shift amount) between the determined value (measured value) and the value of the phase difference $d\varphi$ (calculated value; 0 in this example) that minimizes the value on the graph based on the calculation. Then, the phase shift calculation unit 101*b* writes the calculated $d\varphi_c$ to the phase information 105*b*, in association with information on the phase shifter 122.

The phase information 105*b* obtained as described above is used by the phase control unit 101*a*. For example, when performing beamforming using the antennas 103*a*, 103*b*, and 103*c*, the phase control unit 101*a* refers to the phase information 105*b*, and adjusts the phases of the phase shifters 122 and 123 using the adjustment amounts $d\varphi_b$ and $d\varphi_c$ of the phases calculated by the phase shift calculation unit 101*b*.

Note that the simulation of FIG. 11 is performed under the following conditions: a relative permittivity $\varepsilon$ of the dielectric substrate 104=4.0 and its thickness t=0.2 mm, $L_Y$=0.9 mm, $L_X$=0.6 mm, $\lambda/2$=0.97 mm, D=2.0 mm, $\varphi_a$=0, and A=10 mW. In the simulation of FIG. 12, D is changed to 2.7 mm. In the simulation of FIG. 13, the conditions are changed such that D=2.0, and A=1 mW.

(Distribution of Electromagnetic Field Strength)

Figure 14:
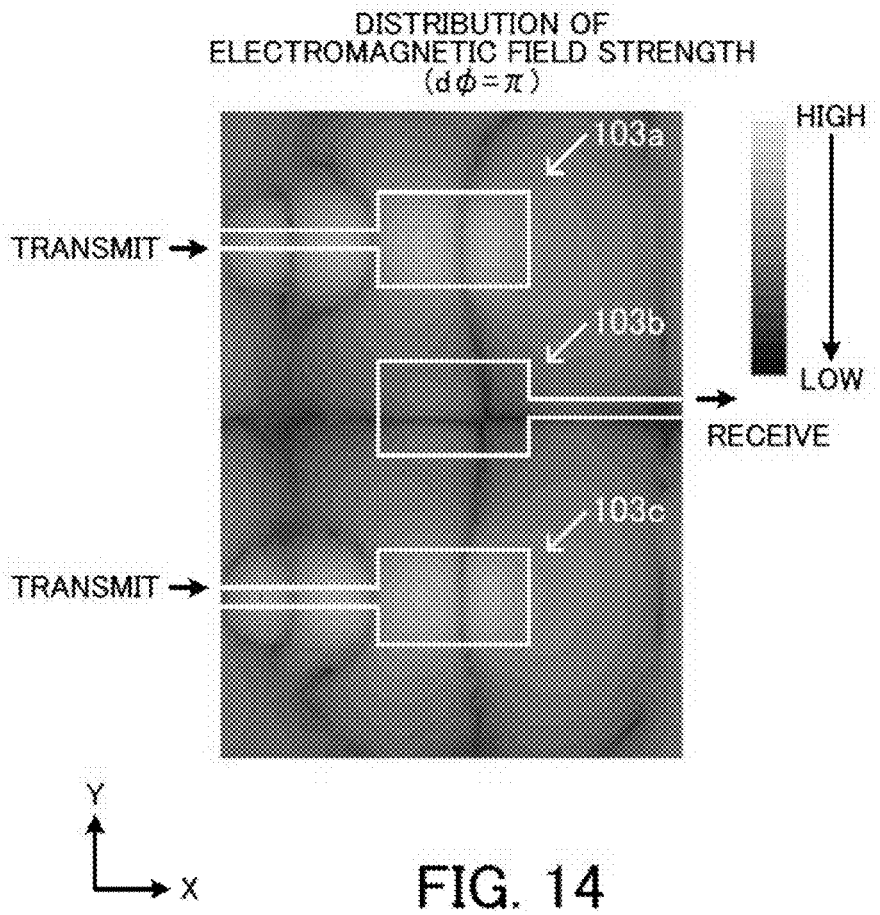
FIG. 14 illustrates the electromagnetic field strength distribution on the flat antennas when the phase difference is π.

As in the simulations of FIGS. 11 and 13, in the case where two signals that have opposite phases at the position of the antenna 103*b* are transmitted from the antennas 103*a* and 103*c*, respectively, and received by the antenna 103*b*, the strength of the electromagnetic field produced at the antenna unit has the distribution illustrated in FIG. 14. FIG. 14 illustrates the electromagnetic field strength distribution on the flat antennas when the phase difference is $\pi$. The electric field directly under the receiving antenna 103*b* is extremely weak, and corresponds to the calculation result that minimizes the detected voltage or the received power.

Figure 15:
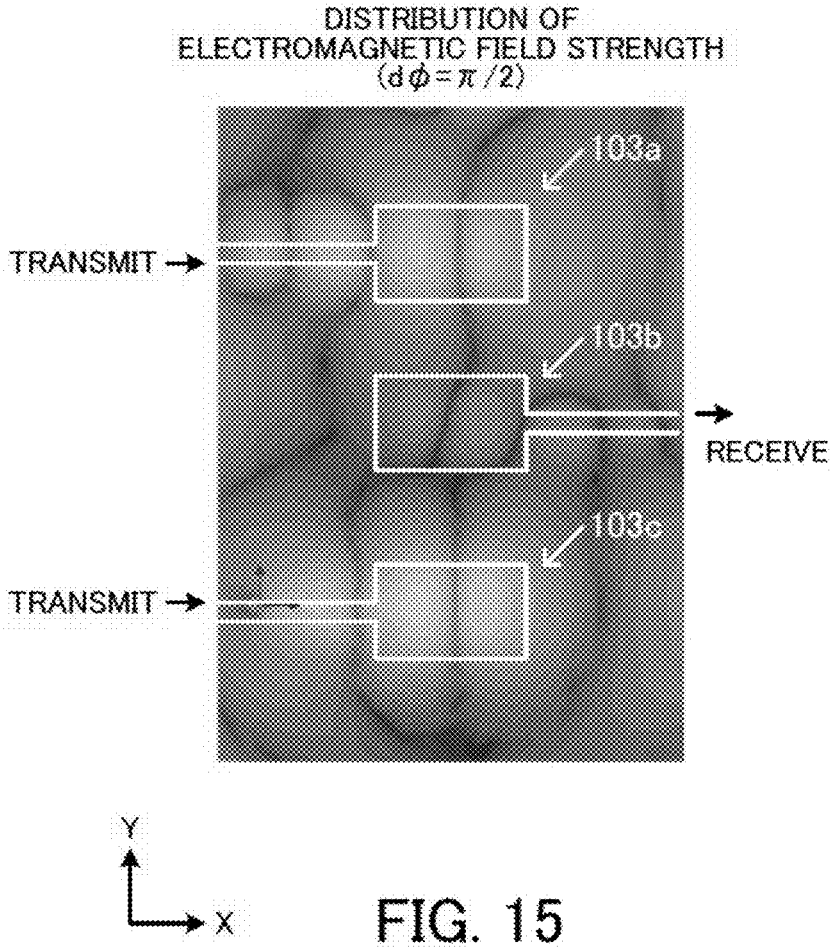
FIG. 15 illustrates the electromagnetic field strength distribution on the flat antennas when the phase difference is π/2.

On the other hand, as in the simulation of FIG. 12, in the case where two signals that have the same phase at the position of the antenna 103*b* are transmitted from the antennas 103*a* and 103*c*, respectively, and received by the antenna 103*b*, the strength of the electromagnetic field produced at the antenna unit has the distribution illustrated in FIG. 15. FIG. 15 illustrates the electromagnetic field strength distribution on the flat antennas when the phase difference is $\pi/2$. An electric field corresponding to the detected voltage or the received power is observed directly under the receiving antenna 103*b*.

In the case of a flat antenna, due to the antenna characteristics that emit strong radio waves in a direction (Z direction) perpendicular to the antenna surface, the component of the radio waves propagating in a direction parallel to the XY plane has a relatively low strength. Further, the radio waves propagating in the direction parallel to the XY plane tend to attenuate under the influence of the dielectric substrate 104 and the adjacent antennas.

Accordingly, in the case of performing the phase adjustment described above on an antenna array having four or more antennas, an antenna close to the receiving antenna is preferably used as a transmitting antenna. As in the example of FIG. 7, two antennas on both adjacent sides of the receiving antenna are preferably used as transmitting antennas. In this case, however, it is not possible to appropriately perform phase adjust between the adjacent antennas. It is therefore preferable to combine phase adjustment using a method where at least one transmitting antenna is adjacent to a receiving antenna as in the example of FIG. 5. Thus, in the case where flat antennas are used, by selecting transmitting antennas closer to a receiving antenna, it is possible to reduce the influence of attenuation and detect a phase shift more accurately.

(2-3) Processing Flow: Phase Shift Calculation

Figure 16:
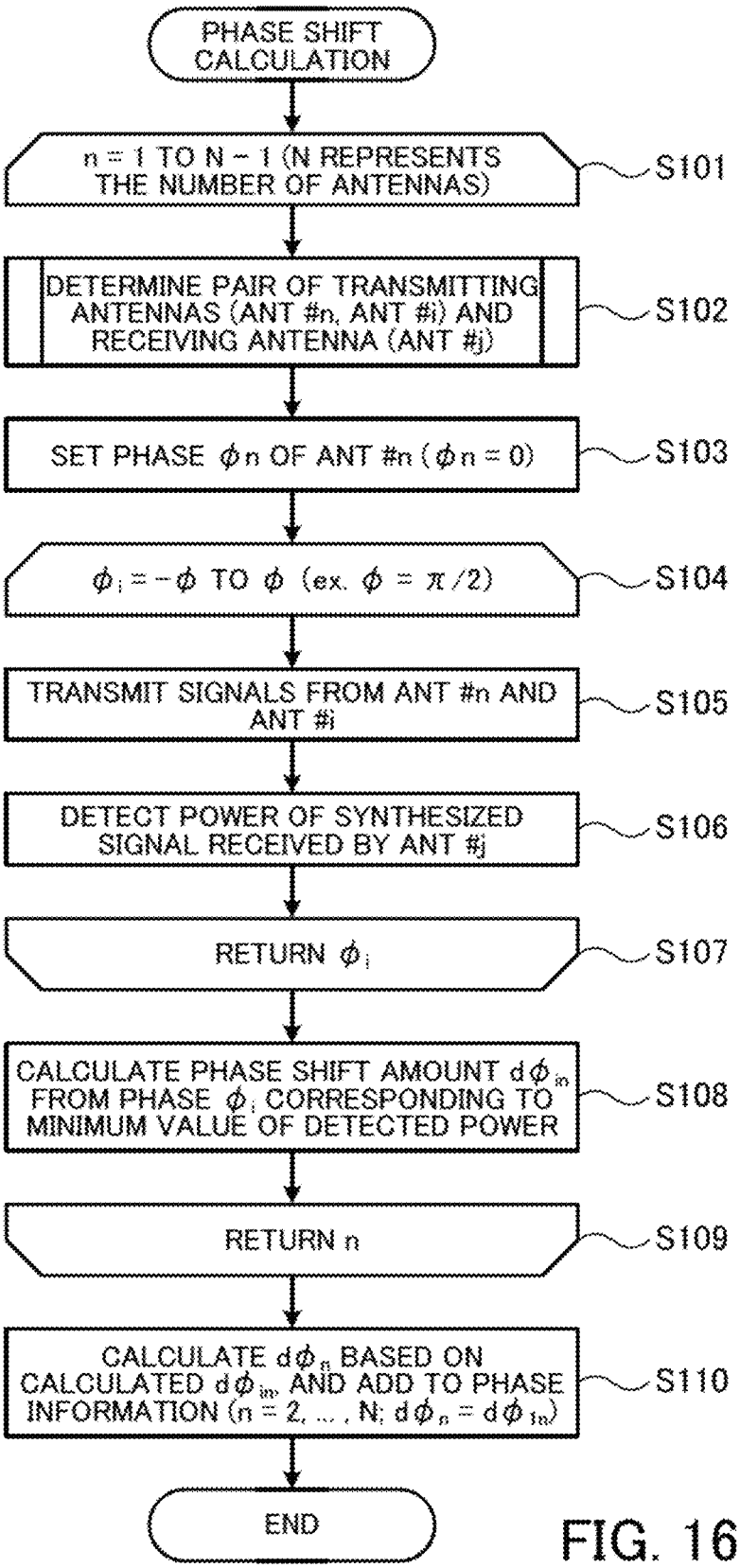
FIG. 16 is a flowchart illustrating the flow of phase shift calculation according to the second embodiment.

Hereinafter, the flow of phase shift calculation will be described with reference to FIG. 16. FIG. 16 is a flowchart illustrating the flow of phase shift calculation according to the second embodiment. In the following description, the number of antennas is denoted by N, and an m-th (m=1, . . . , N) antenna is denoted by ANT #m. Further, the phase of a signal transmitted by ANT #m is denoted by $\varphi_m$, and may be referred to as a phase $\varphi_m$ of ANT #m.

(S101, S109) The phase shift calculation unit 101*b* repeatedly performs the operations of S102 to S108 while varying a parameter n from 1 to N−1.

(S102) The phase shift calculation unit 101*b* determines a pair of transmitting antennas (ANT #n, ANT #i) and a receiving antenna (ANT #j). The method of determining ANT #i and ANT #j will be described below.

(S103) The phase shift calculation unit 101*b* controls a phase shifter connected to a feed line of ANT #n via the phase control unit 101*a*, and sets a phase $\varphi_n$ of a signal transmitted by ANT #n. The value of the phase $\varphi_n$ is preset to 0 or other values.

(S104, S107) The phase shift calculation unit 101*b* repeatedly performs the operations of S105 and S106 while varying a phase $\varphi_i$ of a signal transmitted by ANT #i from $-\varphi$ to $\varphi$. The value of $\varphi$ is preset to $\pi/2$ or other values.

(S105) The phase shift calculation unit 101*b* controls the radio unit 102 to transmit signals from ANT #n and ANT #i. The signals transmitted from ANT #n and ANT have an amplitude A and a wavelength $\lambda$, for example, and have phases shifted by $\varphi_n$ and $\varphi_i$, respectively.

(S106) The phase shift calculation unit 101*b* detects the power of a synthesized signal received by ANT #j. For example, the phase shift calculation unit 101*b* obtains the voltage detected by a detector connected to ANT #j, and converts the voltage into a received power (power of the synthesized signal) using the conversion information 105*a*.

(S108) The phase shift calculation unit 101*b* extracts the minimum value of the power detected in S106, and determines the phase $\varphi_i$ corresponding to the minimum value. Then, the phase shift calculation unit 101*b* calculates a phase shift amount $d\varphi_{in}$ from the determined $\varphi_i$ (measured value). As illustrated in FIGS. 11 and 13, when the antenna interval D, the wavelength $\lambda$, and the phase $\varphi_n$ are known, a calculated value of the phase $\varphi_i$ corresponding to the minimum value of the received power is obtained. Therefore, the phase shift calculation unit 101*b* calculates the difference between the measured value and the calculated value, and determines the calculated difference as the phase shift amount $d\varphi_{in}$.

(S110) The phase shift calculation unit 101*b* calculates a phase shift amount $d\varphi_n$ ($d\varphi_n=d\varphi_m$; the amount of the phase shift with respect to the phase of the signal transmitted by ANT #1) to be added to the phase information 105*b*, based on the phase shift amount $d\varphi_{in}$ calculated in S108. A phase shift amount $d\varphi_{mn}$ is given by expression (9) below. Accordingly, if $d\varphi_p$ ($d\varphi_p=d\varphi_{1p}$) is not included in the calculation results but $d\varphi_{1m}$ and $d\varphi_{mp}$ are obtained, the phase shift calculation unit 101*b* calculates $d\varphi_p$ ($d\varphi_{1p}=d\varphi_{1m}+d\varphi_{mp}$) using equation (9) below.

$$\begin{aligned} d\varphi_{mn} &= \varphi_m - \varphi_n \\ &= \varphi_m - \varphi_q + \varphi_q - \varphi_n \\ &= d\varphi_{mq} + d\varphi_{qn} \end{aligned} \tag{9}$$

(where $q \neq m, n$)

With the method described above, the phase shift calculation unit 101*b* calculates $d\varphi_n$ (n=2, . . . , N), and adds the calculated $d\varphi_n$ to the phase information 105*b*, in association with information on a phase shifter connected to ANT #n. When this phase information 105*b* is obtained, the phase control unit 101*a* is able to adjust the phase of the phase shifter connected to ANT #n (n=2, . . . , N) based on the phase information 105*b*. When the operation of S110 completes, a series of operations illustrated in FIG. 16 ends.

(Antenna Determination Method)

Figure 17:
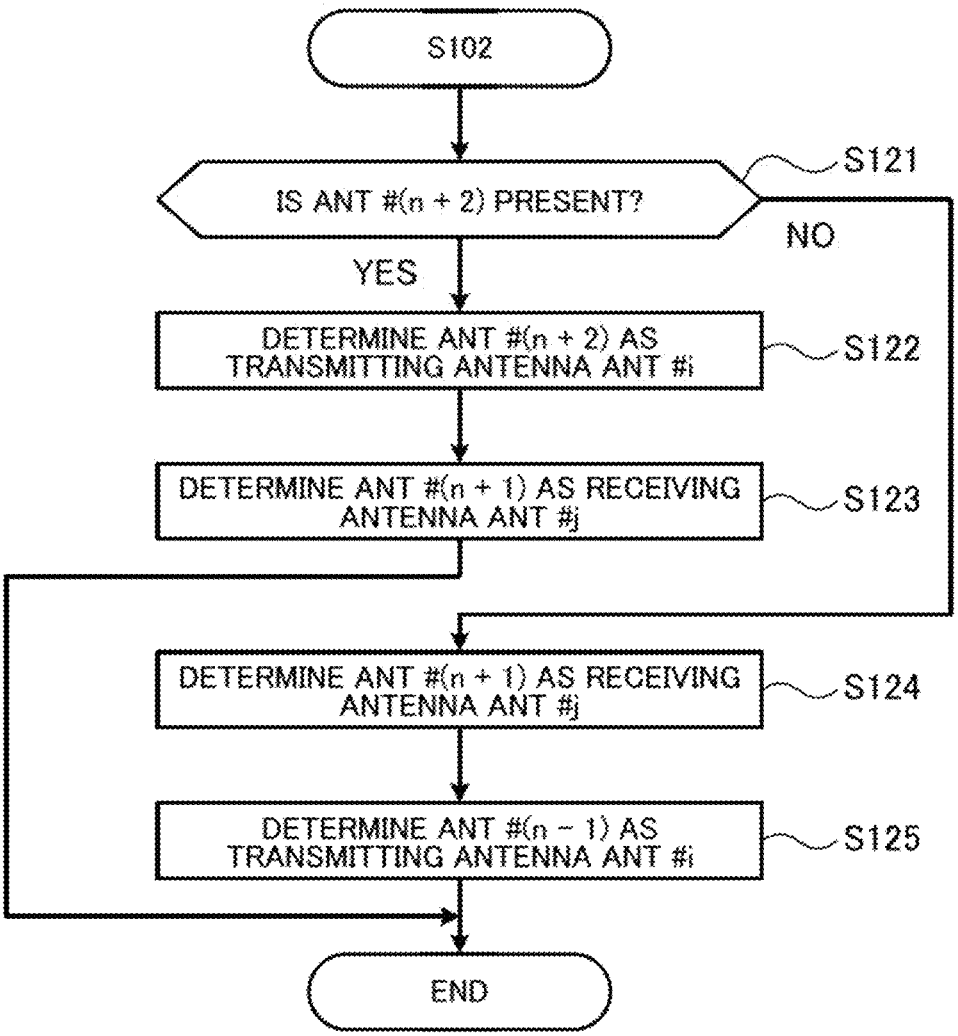
FIG. 17 is a flowchart illustrating the flow of a process of determining a pair of transmitting antennas and a receiving antenna in the phase shift calculation according to the second embodiment.

Hereinafter, a method of determining a pair of transmitting antennas and a receiving antenna will be described with reference to FIG. 17. FIG. 17 is a flowchart illustrating the flow of a process of determining a pair of transmitting antennas and a receiving antenna in the phase shift calculation according to the second embodiment. The operations illustrated in FIG. 17 correspond to the operation of S102 illustrated in FIG. 16.

(S121) The phase shift calculation unit 101*b* determines whether ANT #(n+2) is present. For example, if n is N−2, ANT #(n+2) is present. Meanwhile, if n is N−1, ANT #(n+2) is not present. If ANT #(n+2) is present, the process proceeds to S122. If ANT #(n+2) is not present, the process proceeds to S124.

(S122, S123) The phase shift calculation unit 101*b* determines ANT #(n+2) as the transmitting antenna ANT #i (i=n+2). Further, the phase shift calculation unit 101*b* determines ANT #(n+1) as the receiving antenna ANT #j (j=n+1).

In this case, ANT #n and ANT #(n+2) are determined as transmitting antennas, and ANT #(n+1) is determined as a receiving antenna. That is, two antennas ANT #n and ANT #(n+2) on both adjacent sides of the receiving antenna ANT #(n+1) are selected as transmitting antennas (this case corresponds to the case of FIG. 7). Therefore, attenuation of the signals transmitted from the two transmitting antennas is minimized. Further, when the antenna intervals are equal, the two signals have substantially the same amount of attenuation, which makes the effect of interference (the effect of canceling each other out and the effect of reinforcing each other) more apparent.

When the operation of S123 completes, a series of operations illustrated in FIG. 17 ends.

(S124, S125) The phase shift calculation unit 101*b* determines ANT #(n+1) as the receiving antenna ANT #j (j=n+1). Further, the phase shift calculation unit 101*b* determines ANT #(n−1) as the transmitting antenna ANT #i (i=n−1).

In this case, ANT #n and ANT #(n−1) are determined as transmitting antennas, and ANT #(n+1) is determined as a receiving antenna. That is, the antenna ANT #n adjacent to the receiving antenna ANT #(n+1) and the antenna ANT #(n−1) adjacent to the antenna ANT #n are selected as transmitting antennas (this case corresponds to the case of FIG. 5). In this manner, even when the arrangement in which a receiving antenna is disposed between two transmitting antennas is not possible, it is possible to reduce the influence of attenuation of signals by selecting transmitting antennas closer to the receiving antenna.

When the operation of S125 completes, a series of operations illustrated in FIG. 17 ends.

Note that the method of determining a pair of transmitting antennas and a receiving antenna is not limited to the example described above. However, by positively selecting transmitting antennas closer to a receiving antenna, the accuracy of detecting a phase shift is expected to be improved.

(2-4) Modifications

Hereinafter, modifications according to the second embodiment will be described.

(Method Using Intermediate Value of Phase Difference Corresponding to Predetermined Power Value)

Figure 18:
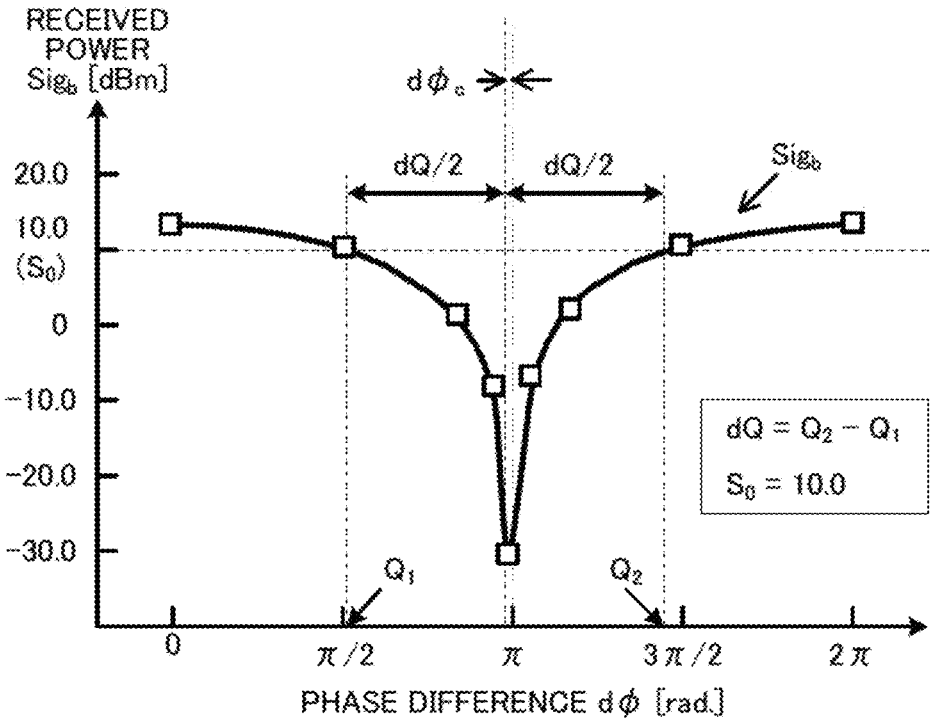
FIG. 18 illustrates a phase shift detection method according to a modification (modification #1) of the second embodiment.

First, a modification (modification #1) related to a method of determining a phase difference dφ that minimizes or maximizes the received power will be described with reference to FIG. 18. FIG. 18 illustrates a phase shift detection method according to the modification (modification #1) of the second embodiment.

As mentioned above, in the second embodiment, the phase difference that minimizes or maximizes the received power of the synthesized signal is detected, and a phase shift is obtained by comparing the value of the detected phase difference and the value of the phase difference obtained by calculation. Therefore, the accuracy of detecting the phase difference that minimizes or maximizes the received power affects the accuracy of calculating the phase shift. In view of this, according to the modification #1, as illustrated in FIG. 18, the phase differences $Q_1$ and $Q_2$ that correspond to a predetermined received power $S_0$ are determined, and the intermediate value between the phase differences $Q_1$ and $Q_2$ is determined as the phase difference that maximizes or minimizes (in the example of FIG. 18, minimizes) the received power.

With the above method, it is possible to accurately detect the phase difference that minimizes or maximizes the received power even when the amount of measurement data of the received power is small or even when sufficient measurement accuracy is not achieved at a part where the received power is minimized or maximized. Another method may be used that sets a plurality of predetermined received powers in advance, calculates the intermediate value in the manner described above for each of the received powers, and uses the average value of the intermediate values. With this method, the error may be further reduced. It is obvious that this modification also falls within the technical scope of the second embodiment.

(Method of Obtaining Phase Shift by Determining and Averaging Phase Differences Corresponding to Maximum Power and Minimum Power)

Figure 19:
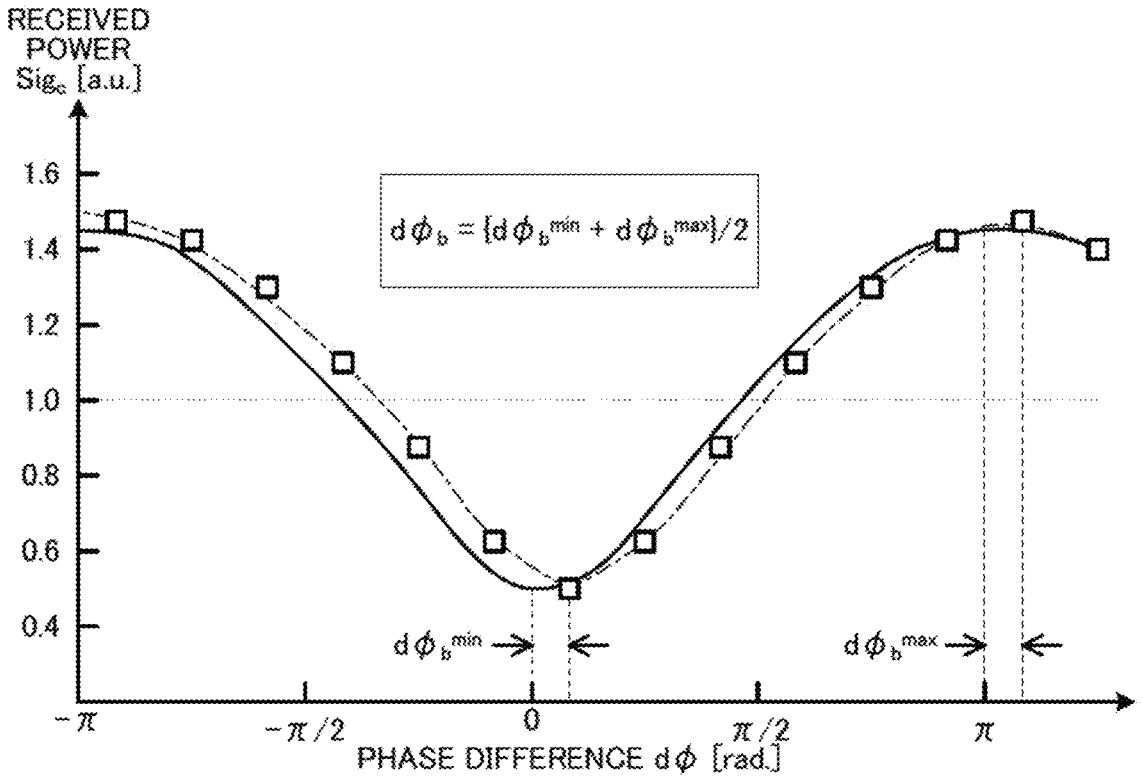
FIG. 19 illustrates a phase shift detection method according to a modification (modification #2) of the second embodiment.

Next, a modification (modification #2) related to a method of determining a phase difference dφ that minimizes or maximizes the received power will be described with reference to FIG. 19. FIG. 19 illustrates a phase shift detection method according to the modification (modification #2) of the second embodiment.

As mentioned above, in the second embodiment, the received power of the synthesized signal is measured while varying the phase difference dφ, and the phase difference that minimizes or maximizes the received power is determined. Then, the phase shift is calculated based on the determined phase difference. In this case, if the phase difference dφ is varied in a sufficiently large range, a point where the signals transmitted from the two transmitting antennas have the same phase and a point where the signals have opposite phases appear. That is, a point where the received power is minimized and a point where the received power is maximized appear in the measured received power pattern.

In the modification #2, by using the above characteristics, as illustrated in FIG. 19, the phase difference (phase difference for minimization) that minimizes the received power and the phase difference (phase difference for maximization) that maximizes the received power are determined, and then the phase shift is obtained based on the values of the determined two phase differences and the calculated values of these two phase differences. For example, the average value of the phase difference for minimization and the phase difference for minimization is determined as the phase shift. With this method, the measurement error of the received power and the error that occurs when determining the phase difference for minimization and the phase difference for maximization may be reduced. It is obvious that this modification also falls within the technical scope of the second embodiment.

(Two-Dimensional Arrangement of Flat Antennas)

For convenience of explanation, the above description has illustrated the method that detects a phase shift using three antennas that are arranged one-dimensionally. However, the technique according to the second embodiment is applicable to a radio communication apparatus having three or more antennas disposed in an arbitrary arrangement.

Figure 20:
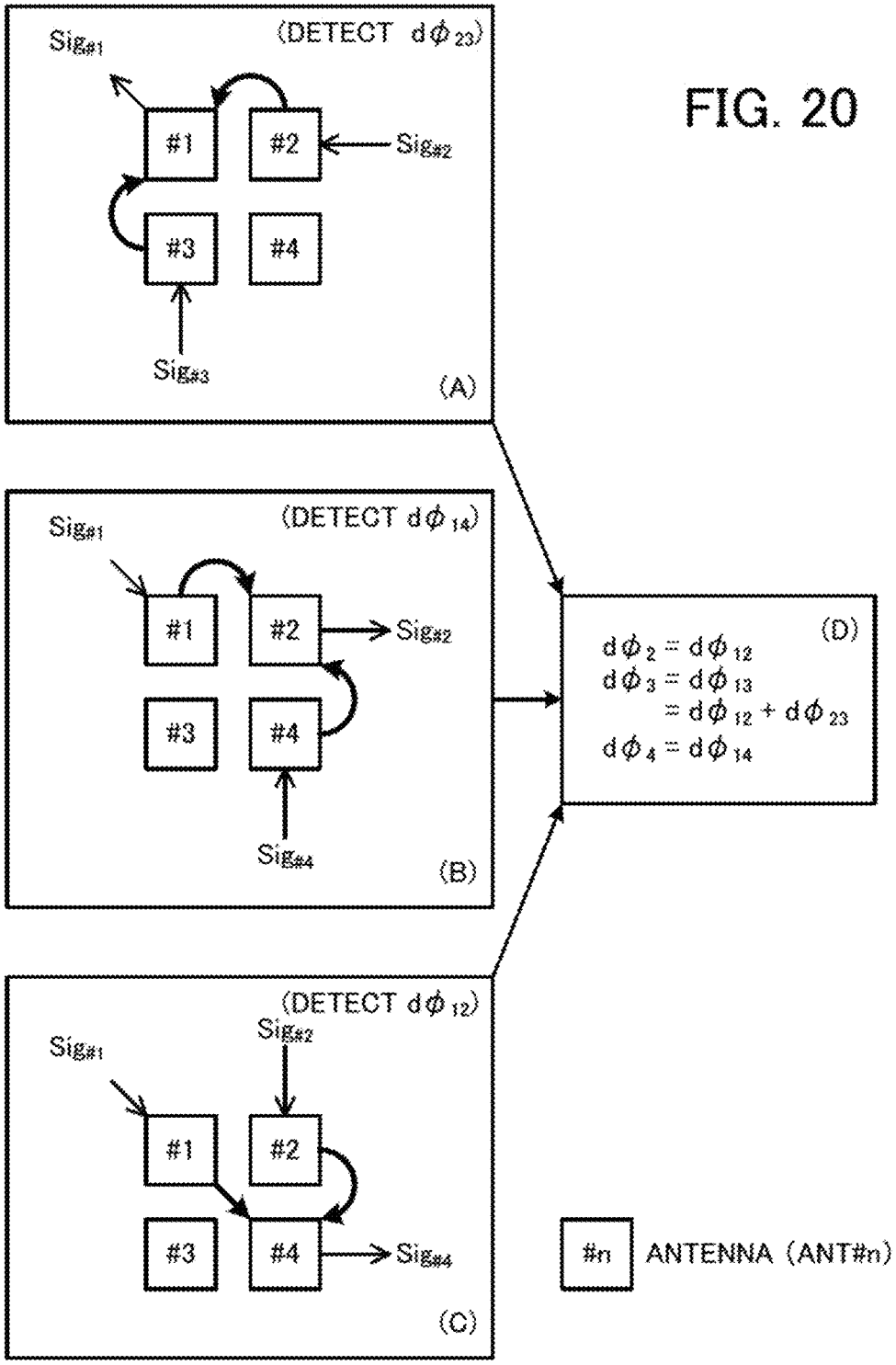
FIG. 20 illustrates the arrangement of antennas and a phase shift adjustment method according to a modification (modification #3) of the second embodiment.

For example, as illustrated in FIG. 20, the technique according to the second embodiment is also applicable to the case (modification #3) where four antennas (ANT #1, ANT #2, ANT #3, and ANT #4) are arranged two-dimensionally. FIG. 20 illustrates the arrangement of antennas and a phase shift adjustment method according to the modification (modification #3) of the second embodiment.

As mentioned above, in the case of a flat antenna, radio waves (including expansion of the electromagnetic field) that travel in a direction parallel to the substrate greatly attenuate in accordance with the distance to travel. Accordingly, the accuracy of detecting a phase shift is improved by selecting transmitting antennas and a receiving antenna closer to each other. Thus, as illustrated in FIG. 20, a combination of transmitting antennas and a receiving antenna is selected such that the distance between the receiving antenna and the transmitting antennas is minimized.

The example of (A) illustrates a method of selecting transmitting antennas in the case where ANT #1 is a receiving antenna. ANT #2, ANT #3, and ANT #4 are all adjacent to ANT #1, but ANT #4 is farther from ANT #1 than ANT #2 and ANT #3. Accordingly, ANT #2 and ANT #3 are selected as transmitting antennas. In this case, a phase shift amount $d\alpha_{23}$ between signals transmitted by ANT #2 and ANT #3 is obtained.

The example of (B) illustrates a method of selecting transmitting antennas in the case where ANT #2 is a receiving antenna. ANT #1, ANT #3, and ANT #4 are all adjacent to ANT #2, but ANT #3 is farther from ANT #2 than ANT #1 and ANT #4. Accordingly, ANT #1 and ANT #4 are selected as transmitting antennas. In this case, a phase shift amount $d\varphi_{14}$ between signals transmitted by ANT #1 and ANT #4 is obtained.

The example of (C) illustrates a method of selecting transmitting antennas in the case where ANT #4 is a receiving antenna. The antennas close to ANT #4 are ANT #2 and ANT #3. Since $d\varphi_{23}$ and $d\varphi_{14}$ have been obtained in (A) and (B), all the phase shifts of ANT #2, ANT #3, and ANT #4 with respect to ANT #1 are calculated if $d\varphi_{12}$ is obtained (see (D)). Accordingly, in this case, ANT #1 and ANT #2 are selected as transmitting antennas. Thus, a phase shift amount $d\varphi_{12}$ between signals transmitted by ANT #1 and ANT #2 is obtained.

The phase shift amount $d\varphi_2$ ($d\varphi_2=d\varphi_{12}$) of ANT #2 with respect to the phase of ANT #1 is obtained in the process of (C). Further, as illustrated in (D), the phase shift amount $d\varphi_3$ ($d\varphi_3=d\varphi_{13}$) of ANT #3 is calculated using $d\varphi_{12}$ obtained in the process of (C) and $d\varphi_{23}$ obtained in the process of (A). Further, the phase shift amount $d\varphi_4$ ($d\varphi_4=d\varphi_{14}$) of ANT #4 is obtained in the process of (B). Accordingly, with the above method, it is possible to adjust the phases of signals transmitted from ANT #2, ANT #3, and ANT #4.

The method of selecting antennas illustrated in FIG. 20 is a mere example. That is, in the case where antennas are arranged two-dimensionally, each of the phase shift amounts $d\varphi_2$, $d\varphi_3$, and $d\varphi_4$ may be obtained for a combination of antennas different from that of the above example. By using these characteristics, it is possible to employ a method that obtains each of the phase shift amounts $d\varphi_2$, $d\varphi_3$, and $d\varphi_4$ for a plurality of combinations, and uses the average value of the values obtained for the respective combinations to adjust the phase, for example. With this method, the error or the like that occurs in the process of detecting a phase shift may be reduced.

Other Modifications

Figure 21:
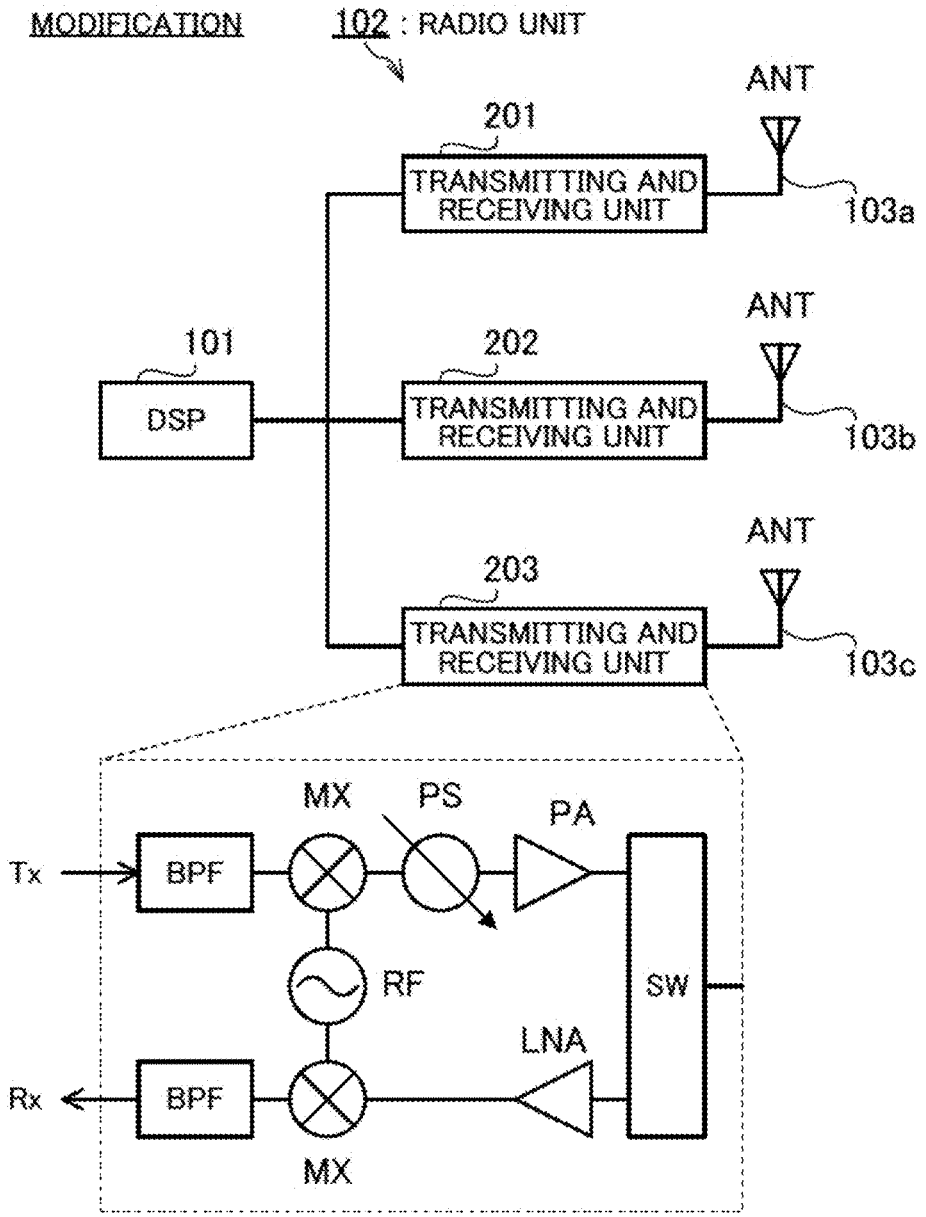
FIG. 21 illustrates an example of a radio communication apparatus according to a modification (modification #4) of the second embodiment.

For convenience of explanation, the above description has illustrated the radio unit 102 of FIG. 3. However, as illustrated in FIG. 21, even in the case (modification #4) where the radio unit 102 includes transmitting and receiving units 201, 202, and 203, the technique of the second embodiment is applicable. FIG. 21 illustrates an example of a radio communication apparatus according to the modification (modification #4) of the second embodiment.

Each of the transmitting and receiving units 201, 202, and 203 includes a band-pass filter (BPF), a mixer (MX), a local oscillator (RF), a phase shifter (PS), a power amplifier (PA), a low noise amplifier (LNA), and a switch (SW).

A baseband transmitting signal Tx is band-limited by the band-pass filter, then is multiplied by a carrier wave output from the local oscillator, and is modulated into an RF signal. The RF signal is adjusted in phase and amplitude by the phase shifter and the power amplifier, and then is output from the antenna via the switch (switching between transmission and reception). Meanwhile, an RF signal that is input to the antenna is input to the low noise amplifier via the switch, is adjusted in amplitude by the low noise amplifier, is converted into a baseband signal, and then is input to the DSP 101 as a baseband received signal Rx via the band-pass filter.

In the case of the modification #4, the power pattern of the received signal (the relationship between the phase difference and the received power) is obtained using the receiving functions of the transmitting and receiving units 201, 202, and 203. Therefore, the technique of the second embodiment may be applied without separately providing the detectors 127, 128, and 129 described above. In this manner, it is possible to apply the technique of the second embodiment even when the elements of the radio unit 102 are changed. Further, while the above description has illustrated flat antennas, the technique of the second embodiment may be applied even when the type and shape of antennas are changed.

The above is a description of the second embodiment.

According to one aspect, it is possible to adjust a phase shift caused by secular changes in a line including an antenna unit.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that various changes, substitutions, and alterations could be made hereto without departing from the spirit and scope of the invention.

What is claimed is:

1. A radio communication apparatus comprising:

a first antenna, a second antenna, and a third antenna; and a processor configured to perform a procedure including:

varying a phase difference between a first signal transmitted from the first antenna and a second signal transmitted from the second antenna, measuring a received power pattern of a synthesized signal of the first signal and the second signal, the synthesized signal being received by the third antenna, and adjusting a phase shift of a signal that is transmitted from the first antenna or the second antenna, based on a difference between the measured received power pattern and a received power pattern obtained by calculation, wherein:

the processor calculates the received power pattern based on an attenuation coefficient dependent on a distance between the first antenna and the third antenna, and dependent on a distance between the second antenna and the third antenna, the processor calculates a first phase difference that maximizes the calculated received power pattern and a second phase difference that minimizes the calculated received power pattern, the processor measures a third phase difference that maximizes the measured received power pattern and a fourth phase difference that minimizes the measured received power pattern, the processor detects a first phase shift by comparing the first phase difference with the third phase difference and a second phase shift by comparing the second phase difference with the fourth phase difference, and the processor adjusts the phase shift of the signal that is transmitted from the first antenna or the second antenna by a value that is determined based on the first phase shift and the second phase shift.

2. The radio communication apparatus according to claim 1, wherein:

the first antenna, the second antenna, and the third antenna are flat antennas disposed on a same substrate; and the third antenna is adjacent to at least one of the first antenna and the second antenna.

3. The radio communication apparatus according to claim 2, wherein the third antenna is adjacent to the first antenna and the second antenna.

4. The radio communication apparatus according to claim 1, wherein the processor determines a pair of phase differences with which the received power of the synthetic signal has a predetermined value, and obtains an intermediate value between the determined phase differences as a measured value of the phase difference.

5. A phase adjustment method for use in a radio communication apparatus having a first antenna, a second antenna, a third antenna, and a processor, the phase adjustment method comprising:

varying, by the processor, a phase difference between a first signal transmitted from the first antenna and a second signal transmitted from the second antenna;

measuring, by the processor, a received power pattern of a synthesized signal of the first signal and the second signal, the synthesized signal being received by the third antenna; and adjusting, by the processor, a phase shift of a signal that is transmitted from the first antenna or the second antenna, based on a difference between the measured received power pattern and a received power pattern obtained by calculation, wherein:

the processor calculates the received power pattern based on an attenuation coefficient dependent on a distance between the first antenna and the third antenna, and dependent on a distance between the second antenna and the third antenna, the processor calculates a first phase difference that maximizes the calculated received power pattern and a second phase difference that minimizes the calculated received power pattern, the processor measures a third phase difference that maximizes the measured received power pattern and a fourth phase difference that minimizes the measured received power pattern, the processor detects a first phase shift by comparing the first phase difference with the third phase difference and a second phase shift by comparing the second phase difference with the fourth phase difference, and the processor adjusts the phase shift of the signal that is transmitted from the first antenna or the second antenna by a value that is determined based on the first phase shift and the second phase shift.

* * * * *